US005208139A

United States Patent [19]

Ishigaki

[11] Patent Number: 5,208,139

[45] Date of Patent: May 4, 1993

[54] SILVER HALIDE PHOTOGRAPHIC MATERIALS

[75] Inventor: Kunio Ishigaki, Kanagawa, Japan

[73] Assignee: Fuji Photo Film Co., Ltd., Kanagawa, Japan

[21] Appl. No.: 960,236

[22] Filed: Oct. 13, 1992

Related U.S. Application Data

[63] Continuation of Ser. No. 804,436, Dec. 10, 1991, abandoned.

[30] Foreign Application Priority Data

Dec. 11, 1990 [JP] Japan ..... 2-409698

[51] Int. Cl.[5] ..... G03C 1/76

[52] U.S. Cl. ..... 430/523; 430/607; 430/631; 430/950

[58] Field of Search ..... 430/523, 607, 631, 950

[56] References Cited

U.S. PATENT DOCUMENTS

| | | | |
|---|---|---|---|
| 3,687,703 | 8/1972 | Ohashi et al. | 430/950 |
| 3,856,527 | 12/1974 | Hamb et al. | 430/950 |
| 3,920,456 | 11/1975 | Nittel et al. | 430/950 |
| 4,266,010 | 5/1981 | Nagatomo et al. | 430/950 |
| 4,552,835 | 11/1985 | Nakamura et al. | 430/950 |
| 4,675,278 | 6/1987 | Sugimoto et al. | 430/950 |
| 4,711,838 | 12/1987 | Grzeskowiak et al. | 430/950 |
| 4,725,526 | 2/1988 | Frass et al. | 430/950 |

*Primary Examiner*—Jack P. Brammer

*Attorney, Agent, or Firm*—Sughrue, Mion, Zinn, Macpeak & Seas

[57] ABSTRACT

A silver halide photographic material is disclosed, comprising a support having thereon at least one silver halide emulsion layer and at least one protective layer above the emulsion layer, wherein colloidal silica is present in at least one of the emulsion layers and the dynamic friction coefficient of the surface of the outermost layer of the protective layer is 0.35 or less.

7 Claims, No Drawings

SILVER HALIDE PHOTOGRAPHIC MATERIALS

This is a continuation of application Ser. No. 07/804,436 filed Dec. 10, 1991, now abandoned.

FIELD OF THE INVENTION

The present invention concerns silver halide photographic materials, and in particular it concerns silver halide photographic materials whose pressure resistance properties are improved.

BACKGROUND OF THE INVENTION

Silver halide photographic materials are in general materials which have a light-sensitive emulsion layer and, as required, various combinations of structural layers such as intermediate layers, protective layers, backing layers, antihalation layers and anti-static layers, for example, coated onto a support such as a synthetic resin film, paper or a paper which has been covered with a synthetic resin, or glass, for example. Silver halide photographic materials frequently exhibit pressure fogging as a result of contact between the photosensitive material and various types of apparatus used in the manufacturing of the material such as processes of coating, drying and finishing, for example, and during transport through a camera, during development processing, during printing or during projection, for example; as a result of contact friction between the photosensitive material and other materials; or as a result of contact friction between photographic materials themselves, e.g., which occurs between a photosensitive material surface and the reverse surface of a photographic material.

Methods in which polymer latexes or plasticizers such as polyhydric alcohols, for example, are included, methods in which the silver halide/gelatin ratio in the silver halide emulsion layer is reduced, methods in which the thickness of the protective layer is increased and methods in which a lubricant or colloidal silica is added to the protective layer, which alleviate pressure before the pressure reaches the silver halide grains, are well known as means of improving the variation in density which results from the application of such pressures.

For example, a method in which heterocyclic compounds are used is disclosed in British Patent 738,618, a method in which alkyl phthalates are used is disclosed in British Patent 738,637, a method in which alkyl esters are used is disclosed in British Patent 738,689, a method in which polyhydric alcohols are used is disclosed in U.S. Pat. No. 2,960,404, a method in which carboxylalkyl cellulose is used is disclosed in U.S. Pat. No. 3,121,060, a method in which paraffins and carboxylic acid salts are used is disclosed in JP-A-49-5017 and a method in which alkyl acrylates and organic acids are used is disclosed in JP-B-53-28086 (the terms "JP-A" and "JP-B" as used herein refer to a "published unexamined Japanese patent application" and an "examined Japanese patent publication", respectively).

However, methods in which plasticizers are added reduce the mechanical strength of the emulsion layer and so the amount of plasticizer which may be used is limited, and when the silver halide/gelatin ratio is reduced, development is retarded and there is the disadvantage in that the suitability for rapid processing is lost.

Furthermore, polyhydroxybenzene compounds have been introduced for various purposes into silver halide photographic materials which contain hydrazine derivatives, as is disclosed, for example, in U.S. Pat. Nos. 4,332,108, 4,385,108 and 4,377,634, and a technique for the prevention of pressure sensitization is disclosed in JP-A-62-21143.

However, in the printing industry there is a great desire for greater efficiency and increased operational speeds, and there is a wide ranging need for increased scanning speeds and shorter processing times for photosensitive materials.

In order to respond to these requirements of the printing industry, it is desirable to increase the scanning speeds in exposing devices (scanners and plotters) and to increase the number of lines and to stop down the beam in the light amount in order to improve picture quality. Thus, in connection with silver halide photographic materials, there is a need for higher photographic speeds with excellent stability and for suitability for rapid development processing.

Here, the term rapid development processing signifies processing in which the time elapsing from the entry of the leading edge of the film into an automatic processor through the development tank, the crossover part, the fixing tank, the crossover part, the water washing tank and the drying part until the leading edge of the film emerges from the drying part is from 15 to 60 seconds.

In order to provide a photosensitive material with suitability for rapid processing it is necessary to increase the rate of development and the fixing rate and to shorten the drying time, and for this the amount of gelatin which is used as a binder in the emulsion layer and the protective layer must be reduced. In particular, the thickness of the protective layer must be reduced and this results in a marked increase in pressure fogging.

SUMMARY OF THE INVENTION

An object of the present invention is to provide silver halide photographic materials with an improvement in pressure fogging which is caused by contact friction with various materials and which can be subjected to rapid processing.

The objects of the present invention are realized by a silver halide photographic material comprising a support having thereon at least one silver halide emulsion layer and at least one protective layer above the emulsion layer, wherein colloidal silica is present in at least one of the emulsion layers and the dynamic friction coefficient of the surface of the outermost layer of the protective layer is 0.35 or less.

DETAILED DESCRIPTION OF THE INVENTION

The colloidal silica which is used in the present invention has an average particle size of generally from 5 mμ to 1,000 mμ, and preferably from 5 mμ to 500 mμ. The colloidal silica is $SiO_2$, but for example, alumina or sodium aluminate may be included as minor components (i.e., stabilizers) of the colloidal silica (an amount of the components: 3.0 wt % or less based on the colloidal silica), together with the colloidal silica. Furthermore, inorganic bases such as sodium hydroxide, potassium hydroxide, lithium hydroxide and ammonia, and organic bases such as tetramethylammonium ions, may be included as stabilizers (preferably in an amount of 1.0 wt % or less based on the colloidal silica) in this colloidal silica.

Colloidal silica of this type is disclosed in JP-A-53-112732, JP-B-57-009051 and JP-B-57-051653.

Specific examples of colloidal silica are available commercially from Nissan Chemicals (Tokyo, Japan) under the trade names Snowtex 20 ($SiO_2/Na_2O \geqq 57$), Snowtex 30 ($SiO_2/Na_2O) \geqq 50$), Snowtex C ($SiO_2/Na_2O \geqq 100$) and Snowtex O ($SiO_2/Na_2O) \geqq 500$), for example. Here, the ratio $SiO_2/Na_2O$ represents the ratio by weight of the amount of silicon dioxide ($SiO_2$) and sodium hydroxide present, the sodium hydroxide being calculated as $Na_2O$, and the values given are those listed in the trade literature (i.e., the catalog).

The amount of colloidal silica used in the silver halide emulsion layer of the present invention in terms of the dry weight ratio based on the gelatin which is used as the binder in the layer in which the colloidal silica is present is preferably from 0.05 to 1.0, and most desirably from 0.1 to 0.6.

The dynamic friction coefficient ($\mu k$) in the present invention can be obtained using the same principle as the friction coefficient test method described in JIS K7125. Thus, after allowing a sample to stand for 1 hour under the conditions of 25° C., 60% RH, a sapphire needle (for example, having a diameter of from 0.5 to 5 mm) is applied to the sample under a constant load (the contact force, Fp) (for example, Fp: from 50 to 200 g) and the surface of the silver halide photographic materials is moved at constant speed (for example, from 20 to 100 cm/min), the tangential force (Fk) at this time is measured and the dynamic friction coefficient is determined using the equation shown below.

$$\mu k = \frac{Fk}{Fp}$$

$\mu k$: Dynamic friction coefficient

Fk: Tangential force (g)

Fp: Contact force (g)

For example, measurements can be made using a device for measuring surface properties (model HEIDON-14) made by Shinto Science (Co.).

Lubricants are preferably used to set the dynamic friction coefficient of the outermost layer to 0.35 or less in the present invention.

Typical lubricants which can be used in the present invention include silicone based lubricants disclosed, for example, in U.S. Pat. No. 3,042,522, British Patent 955,061, U.S. Pat. Nos. 3,080,317, 4,004,927, 4,047,958 and 3,489,567, and British Patent 1,143,118; higher fatty acid based, alcohol based and acid amide based lubricants disclosed, for example, in U.S. Pat. Nos. 2,454,043, 2,732,305, 2,976,148 and 3,206,311, and German Patents 1,284,295 and 1,284,294; metal soaps disclosed, for example, in British Patent 1,263,722 and U.S. Pat. No. 3,933,516; ester based and ether based lubricants disclosed in U.S. Pat. Nos. 2,588,765 and 3,121,060, and British Patent 1,198,387; taurine based lubricants disclosed in U.S. Pat. Nos. 3,502,473 and 3,042,222, and the above described colloidal silica.

The alkylpolysiloxanes which can be represented by formula (I), formula (II) or formula (III) shown below and liquid paraffins which are in a liquid state at room temperature (e.g., about 20° to 30° C.) is preferably used as the lubricant in the present invention. Moreover, the use of the alkylpolysiloxanes which have a polyoxyalkylene chain as a side chain represented by formula (I) and the alkylpolysiloxanes represented by formula (II) is especially desirable.

(I)

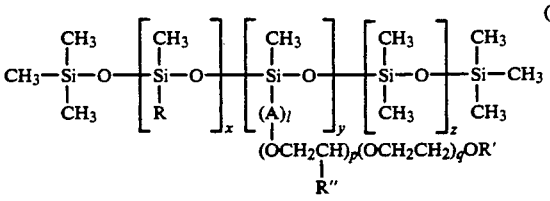

In the formula (I), R represents an aliphatic group (for example, an alkyl group (which preferably has from 1 to 8 carbon atoms), a substituted alkyl group (such as aralkyl, alkoxyalkyl or aryloxyalkyl, for example)) or an aryl group (for example, phenyl). R′ represents a hydrogen atom, an aliphatic group (for example, an alkyl group (which preferably has from 1 to 12 carbon atoms) or a substituted alkyl group), or an aryl group (for example, phenyl). R″ represents an alkyl group (for example, methyl) or an alkoxyalkyl group (for example, methoxymethyl). A represents a divalent residual group of an aliphatic hydrocarbon. Moreover, l represents 0 or an integer of from 1 to 12, p is a number of from 0 to 50, q is a number of from 2 to 50 (and preferably from 2 to 30), x is a number of from 0 to 100, y is a number of from 1 to 50 and z is a number of from 0 to 100, and $x+y+z$ is a number of from 5 to 250 (and preferably of from 10 to 50).

Specific examples of R include methyl, ethyl, propyl, pentyl, cyclopentyl, cyclohexyl, dimethylpentyl, heptyl, methylhexyl, octyl, dodecyl, octadecyl, phenylethyl, methylphenylethyl, phenylpropyl, cyclohexylpropyl, benzyloxypropyl, phenoxypropyl, ethyloxypropyl, butyloxyethyl, and phenyl. Examples of groups represented by A include methylene, 1-one-trimethylene and 2-methyl-1-one-trimethylene. Examples of the alkyl groups represented by R′ include methyl, ethyl, propyl, butyl, amyl, hexyl, heptyl, octyl, nonyl, decyl and dodecyl.

(II)

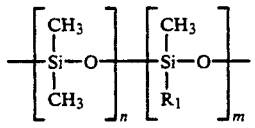

Formula (II) includes cyclic siloxanes which have siloxane units which can be represented by formula (II-1) and linear siloxanes which have terminal groups which can be represented by formula (II-2).

(II-1)

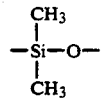

(II-2)

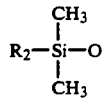

In these formulae (II-1) and (II-2), $R_1$ represents an alkyl group which has from 5 to 20 carbon atoms, a cycloalkyl group, an alkoxyalkyl group, an arylalkyl group, an aryloxyalkyl group or a glycidyloxyalkyl group.

$R_2$ represents an alkyl group which has from 1 to 20 carbon atoms, or a cycloalkyl group, an alkoxyalkyl group, an arylalkyl group, an aryloxyalkyl group or a glycidyloxyalkyl group which has from 5 to 20 carbon atoms.

Moreover, n is 0 or has a numerical value of at least 1, m has a numerical value of at least 1, and n+m has a numerical value of from 1 to 1,000. Moreover, n+m is preferably from 2 to 500.

Specific examples of $R_1$ in compounds represented by formula (II) include pentyl, methylpentyl, cyclopentyl, cyclohexyl, dimethylpentyl, heptyl, methylheptyl, octyl, eicosyl, phenylethyl, methylphenylethyl, phenylpropyl, cyclohexylpropyl, benzyloxypropyl, phenoxypropyl, tolyloxypropyl, naphthylpropyl, ethyloxypropyl, butyloxypropyl, octadecyloxypropyl, glycidyloxypropyl and glycidyloxybutyl.

(III)

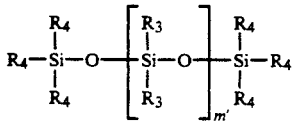

In the formula (III), $R_3$ represents an alkyl group which has from 1 to 3 carbon atoms and $R_4$ represents an alkyl group which has from 1 to 3 carbon atoms or an alkoxy group which has 1 or 2 carbon atoms. Moreover, m' is an integer of from 0 to 2,000.

Typical examples of compounds represented by formula (I) are shown below.

(I-a)

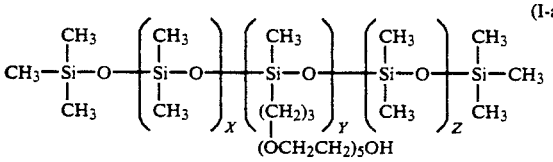

X + Y + Z = 30

(I-b)

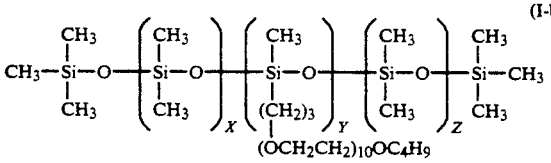

X + Y + Z = 40

(I-c)

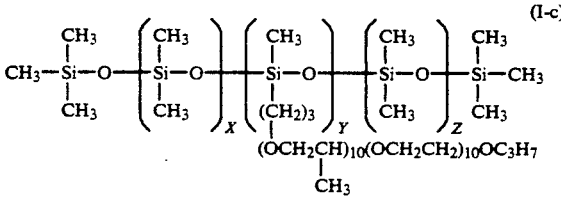

X + Y + Z = 35

(I-d)

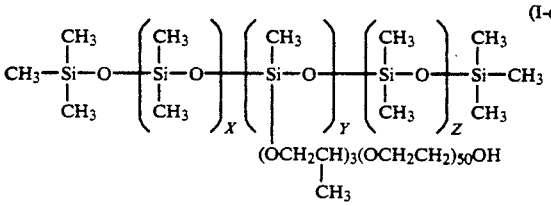

X + Y + Z = 50

-continued (I-e)

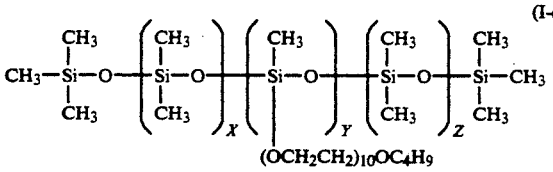

X + Y + Z = 100

(I-f)

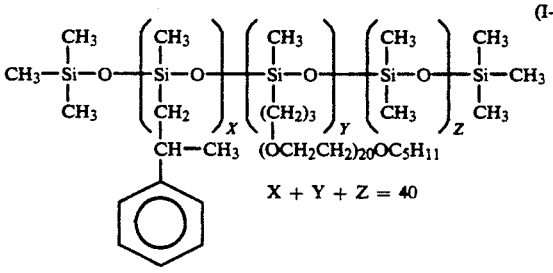

X + Y + Z = 40

Typical examples of the compounds represented by formula (II) are shown below.

(II-a)

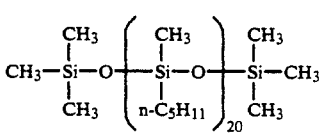

(II-b)

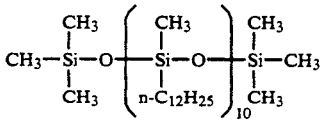

(II-c)

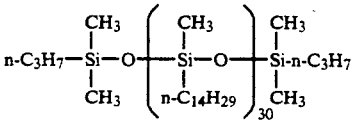

(II-d)

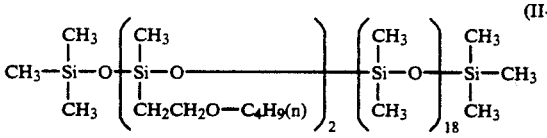

(II-e)

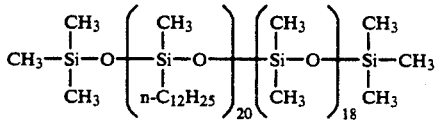

(II-f)

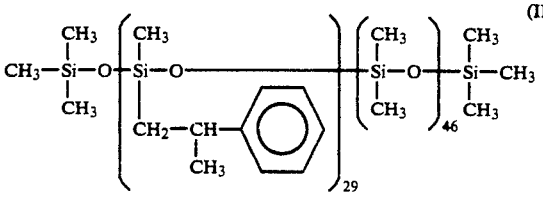

-continued (II-g)

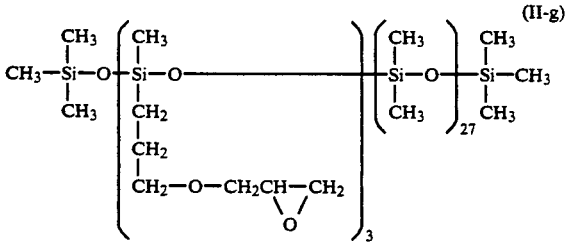

Typical examples of the compounds represented by formula (III) are shown below.

(III-a)

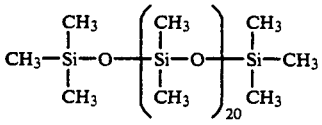

(III-b)

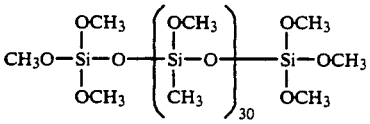

The use of anionic surfactants represented by formula (IV) shown below is also desirable in the present invention.

(IV)

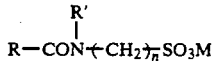

In the formula (IV), R represents a substituted or unsubstituted alkyl group which has from 3 to 30 carbon atoms, an unsubstituted or substituted alkenyl group which has from 3 to 30 carbon atoms or an unsubstituted or substituted aryl group which has from 6 to 30 carbon atoms, and R' represents a hydrogen atom, a substituted or unsubstituted alkyl group which has from 1 to 10 carbon atoms, an unsubstituted or substituted alkenyl group or an unsubstituted or substituted aryl group. Moreover, n represents a number of from 2 to 6, and M represents a hydrogen atom or an inorganic or organic cation.

Specific illustrative examples of anionic surfactants which can be used in the present invention are shown below.

$C_3H_7CONHCH_2CH_2SO_3Na$ (IV-a)

$C_9H_{19}CONHCH_2CH_2SO_3Na$ (IV-b)

$C_{17}H_{33}CONHCH_2CH_2SO_3Na$ (IV-c)

(IV-d)

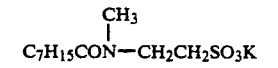

(IV-e)

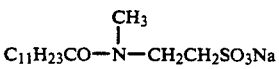

(IV-f)

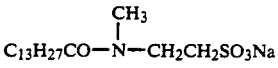

(IV-g)

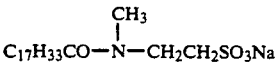

-continued (IV-h)

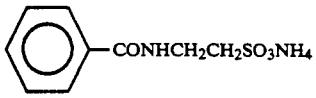

(IV-i)

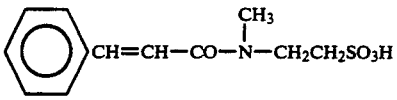

(IV-j)

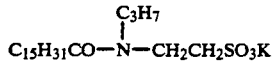

The amount of lubricant coated in terms of the ratio by weight based on the amount of binder in the outermost layer is preferably from 0.01 to 1.0, more preferably from 0.05 to 0.5, and most preferably from 0.01 to 0.1.

Furthermore, in those cases where an anionic surfactant represented by formula (IV) is present, the amount of anionic surfactant used is preferably from 0.001 to 0.5 $g/m^2$ and more preferably from 0.01 to 0.2 $g/m^2$.

The dynamic friction coefficient ($\mu k$) is generally 0.35 or less, and preferably is from 0.35 to 0.10.

The use of polyhydroxybenzene compounds to increase pressure resistance and improve shelf life without loss of sensitivity is also desirable in the present invention. Compounds which have any of the structures shown below are preferred as polyhydroxybenzene compounds.

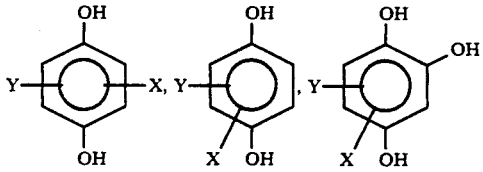

wherein X and Y each represents —H, —OH, a halogen atom, —OM (where M is an alkali metal atom), an alkyl group, a phenyl group, an amino group, a carbonyl group, a sulfo group, a sulfonphenyl group, a sulfonalkyl group, a sulfonamino group, a sulfoncarbonyl group, a carboxyphenyl group, a carboxyalkyl group, a carboxyamino group, a hydroxyphenyl group, a hydroxyalkyl group, an alkylether group, an alkylphenyl group, an alkylthioether group or a phenylthioether group.

More desirably, X and Y each represents, for example, —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

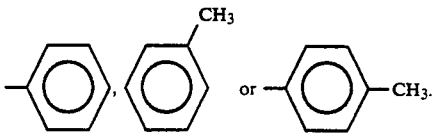

X and Y may be the same or different.

Preferred illustrative compounds are shown below.

H-(1)
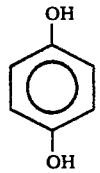
H-(2)
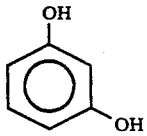
H-(3)
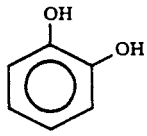
H-(4)
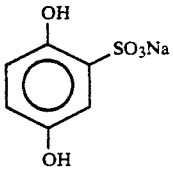
H-(5)
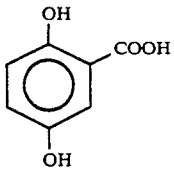
H-(6)
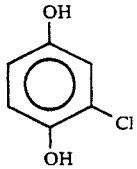
H-(7)
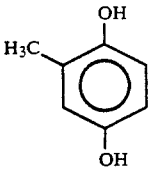
H-(8)
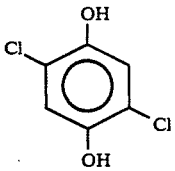
H-(9)
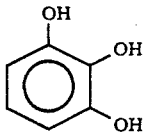
-continued
H-(10)
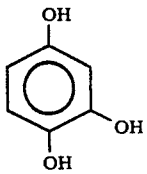
H-(11)
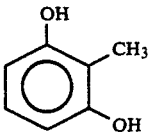
H-(12)
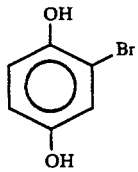
H-(13)
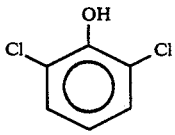
H-(14)
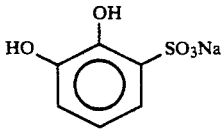
H-(15)
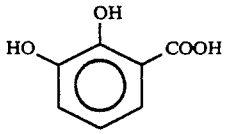
H-(16)
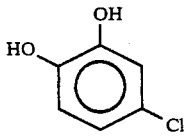
H-(17)
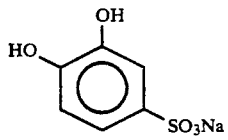
H-(18)
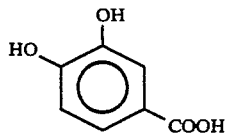
H-(19)
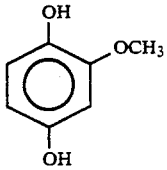

-continued

H-(20)

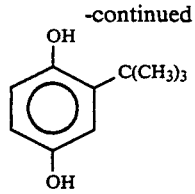

H-(21)

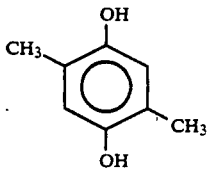

H-(22)

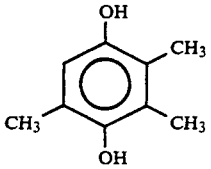

The polyhydroxybenzene compounds may be present in an emulsion layer of the sensitive material or to a layer other than an emulsion layer. An amount of the polyhydroxybenzene compound used is preferably from $1\times10^{-5}$ to 1 mol per mol of silver and more preferably from $1\times10^{-3}$ to $1\times10^{-1}$ mol per mol of silver.

In the present invention the protective layer preferably comprises at least two layers. There is a disadvantage in that the hydrophilic colloid layers become brittle when a silver halide photographic material is stored under low humidity conditions. The inclusion of a polymer latex which has a glass transition point (referred to hereinafter as Tg) of 20° C. or less in the emulsion layer and/or protective layer is desirable to improve this situation. When the protective layer comprises two or more layers, the inclusion of the polymer latex in an intermediate layer between the emulsion layer and the outermost layer is desirable because brittleness is improved without loss of film strength in development processing solutions or adhesion of sensitive materials under the conditions of high humidity.

Moreover, if colloidal silica is present together with other lubricants in the outermost layer, the dry film strength is improved at the same time as the slipping properties are improved and this is desirable from the viewpoint of further improving scratch resistance. The amount of colloidal silica which is present in the outermost layer of the protective layer is, in terms of the ratio by weight with respect to the amount of binder in the outermost layer, generally from 0.01 to 1.0, and most desirably from 0.1 to 0.5.

Hydrates of vinyl polymers such as acrylic acid esters, methacrylic acid esters or styrene, for example, as disclosed, for example, in U.S. Pat. Nos. 2,772,166, 3,325,286, 3,411,911, 3,311,912 and 3,525,620 and *Research Disclosure*, No. 195, 19551 (July, 1980) can be used as polymer latexes contained in the protective layer in the present invention.

Preferred polymer latexes of which the Tg is 20° C. or less include homopolymers of alkyl acrylates, such as methyl acrylate, ethyl acrylate and butyl acrylate, copolymers such as alkyl acrylates with acrylic acid and N-methylolacrylamide, for example (which preferably have an acrylic acid, etc., copolymer component of up to 30 wt %), butadiene homopolymers or copolymers of butadiene and one or more of styrene, butoxymethylacrylamide and acrylic acid, and vinylidene chloride-methyl acrylate-acrylic acid terpolymers.

The Tg of a polymer latex can be obtained using differential scanning calorimetry (DSC).

A preferred range for the average particle size of a polymer latex which is used in the present invention is from 0.005 to 1 μm, and most desirably from 0.02 to 0.1 μm.

The amount of polymer latex employed is generally from 5 to 200%, and preferably from 10 to 100%, based on the amount of hydrophilic colloid in the layer in which it is present.

Specific examples of polymer latexes having Tg of 20° C. or less which can be used in the present invention are shown below, but the polymer latex is not limited to these examples.

M-1

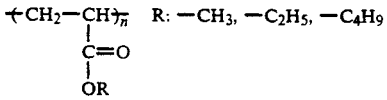

R: $-CH_3$, $-C_2H_5$, $-C_4H_9$

M-2

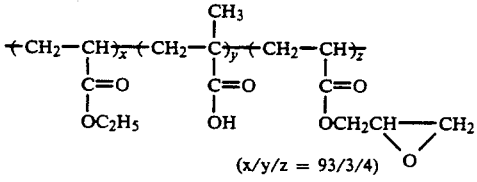

(x/y/z = 93/3/4)

M-3

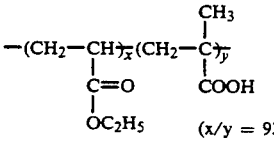

(x/y = 93/7)

M-4

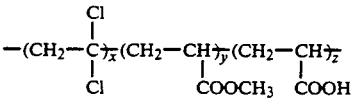

x/y/z = 85/13/2

-continued

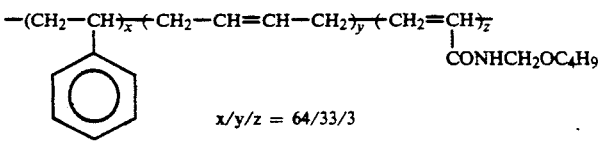

x/y/z = 64/33/3 M-5

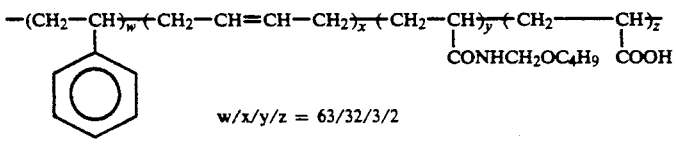

w/x/y/z = 63/32/3/2 M-6

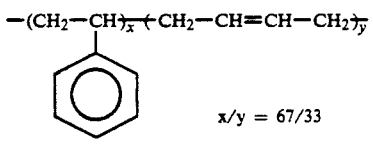

x/y = 67/33 M-7

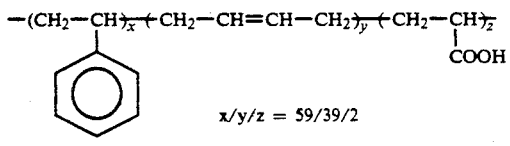

x/y/z = 59/39/2 M-8

Dyes, for example, can be included in the photosensitive material of the present invention for antihalation purposes, to improve safe-light safety and for improving reverse side recognition.

For example, use can be made of the pyrazolone oxonol dyes disclosed in U.S. Pat. No. 2,274,782, the diarylazo dyes disclosed in U.S. Pat. No. 2,956,879, the styryl dyes and butadienyl dyes disclosed in U.S. Pat. Nos. 3,423,207 and 3,384,487, the merocyanine dyes disclosed in U.S. Pat. No. 2,527,583, the merocyanine dyes and oxonol dyes disclosed in U.S. Pat. Nos. 3,486,897, 3,652,284 and 3,718,472, the enamino hemioxonol dyes disclosed in U.S. Pat. No. 3,976,661 and the dyes disclosed in British Patents 584,609 and 1,177,429, JP-A-48-85130, JP-A-49-99620, JP-A-49-114420, and U.S. Pat. Nos. 2,533,472, 3,148,187, 3,177,078, 3,247,127, 3,540,887, 3,575,704 and 3,653,905.

Tetrazolium compounds or hydrazine derivatives may also be present in the emulsion layer or in a layer adjacent thereto in the photosensitive material of the present invention.

The use of the compounds disclosed in JP-A-53-17719, JP-A-53-17720, JP-A-53-95618, JP-A-58-186740 or JP-A-61-117535 as tetrazolium compounds used in the present invention is desirable, and the compounds listed below are especially desirable.

(1) 2-(Benzothiazol-2-yl)-3-phenyl-5-dodecyl-2H-tetrazolium bromide
(2) 2,3-Diphenyl-5-(4-tert-octyloxyphenyl)-2H-tetrazolium chloride
(3) 2,3,5-Triphenyl-2H-tetrazolium
(4) 2,3,5-Tri(p-carboxyethylphenyl)-2H-tetrazolium
(5) 2-(Benzothiazol-2-yl)-3-phenyl-5-(o-chlorophenyl)-2H-tetrazolium The tetrazolium compounds used in the present invention are preferably employed in an amount of from $1\times10^{-3}$ to $5\times10^{-2}$ mol, and particularly from $5\times10^{-3}$ to $3\times10^{-2}$ mol, per mol of silver halide.

The hydrazine derivatives which can be used in the present invention are preferably compounds represented by formula (V) indicated below.

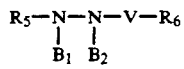

(V)

In the formula (V), $R_5$ represents an aliphatic group or an aromatic group, and $R_6$ represents a hydrogen atom, an alkyl group, an aryl group, an alkoxy group, an aryloxy group, an amino group or a hydrazino group, V represents a

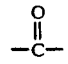

group, an $-SO_2-$ group, an $-SO-$ group, a thiocarbonyl group or an iminomethylene group, and $B_1$ and $B_2$ are both hydrogen atoms or one represents a hydrogen atom and the other represents a substituted or unsubstituted alkylsulfonyl group, or a substituted or unsubstituted arylsulfonyl group, or a substituted or unsubstituted acyl group.

Aliphatic groups represented by $R_5$ in formula (V) preferably have from 1 to 30 carbon atoms, and they are most desirably linear, branched or cyclic alkyl groups which have from 1 to 20 carbon atoms which may be substituted.

Aromatic groups represented by $R_5$ in formula (V) are monocyclic or bicyclic aryl groups or unsaturated heterocyclic groups. Here, an unsaturated heterocyclic group may be condensed with an aryl group.

Aryl groups are preferred for $R_5$, and those which contain a benzene ring are especially preferred.

The aliphatic groups or aromatic groups for $R_5$ may have substituents, and typical examples of substituents include alkyl groups, aralkyl groups, alkenyl groups, alkynyl groups, alkoxy groups, aryl groups, substituted amino groups, ureido groups, urethane groups, aryloxy groups, sulfamoyl groups, carbamoyl groups, alkyl- or arylthio groups, alkyl- or arylsulfonyl groups, alkyl- or arylsulfinyl groups, hydroxy groups, halogen atoms, cyano groups, sulfo groups, aryloxycarbonyl groups, acyl groups, alkoxycarbonyl groups, acyloxy groups, carboxamide groups, sulfonamide groups, carboxyl groups, phosphonamide groups, diacylamino groups, imide groups and $R_6$—NHCON($R_6$)CO— groups, and the preferred substituents are alkyl groups (which preferably have from 1 to 20 carbon atoms), aralkyl groups (which preferably have from 7 to 30 carbon atoms), alkoxy groups (which preferably have from 1 to 20 carbon atoms), substituted amino groups (preferably amino groups substituted with alkyl groups which have from 1 to 20 carbon atoms), acylamino groups (which preferably have from 2 to 30 carbon atoms), sulfonamide groups (which preferably have from 1 to 30 carbon atoms), ureido groups (which preferably have from 1 to 30 carbon atoms) and phosphonamide groups (which preferably have from 1 to 30 carbon atoms).

Alkyl groups represented by $R_6$ in formula (V) are preferably alkyl groups which have from 1 to 4 carbon atoms, and monocyclic or bicyclic aryl groups (for example those containing a benzene ring) are preferred as aryl groups.

In those cases where V is a —CO— group, $R_6$ is preferably a hydrogen atom, an alkyl group (for example, methyl, trifluoromethyl, 3-hydroxypropyl, 3-methanesulfonamidopropyl, phenylsulfonylmethyl), an aralkyl group (for example, o-hydroxybenzyl) or an aryl group (for example, phenyl, 3,5-dichlorophenyl, o-methanesulfonamidophenyl, 4-methanesulfonylphenyl, 2-hydroxymethylphenyl), and among these, a hydrogen atom is most preferred.

$R_6$ may be substituted, and substituents cited as examples of substituents for $R_5$ can be used here as substituents.

The —CO— group is the most desirable group for V in formula (V).

Furthermore, $R_6$ may be a group such that the V-$R_6$ moiety is cleaved from the remainder of the molecule and a cyclization reaction occurs in which a ring structure which contains the atoms of the —V—$R_6$ moiety is formed, and that disclosed, for example, in JP-A-63-29751 can be cited as an example.

$B_1$ and $B_2$ are most desirably hydrogen atoms.

$R_5$ or $R_6$ in formula (V) may include a ballast group or a polymer which has been introduced in the normal way to render immobile photographically useful additives such as couplers, for example. A ballast group is a group which has at least 8 carbon atoms which is comparatively inert with respect to photographic properties, and is selected from alkyl groups, alkoxy groups, phenyl groups, alkylphenyl groups, phenoxy groups and alkylphenoxy groups, for example. Furthermore, those disclosed, for example, in JP-A-1-100530 can be cited as polymers.

$R_5$ or $R_6$ in formula (V) may incorporate a group which is strongly adsorbed on a silver halide grain surface. Thiourea groups, heterocyclic thioamide groups, mercapto heterocyclic groups and triazole groups, for example, as disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234246, and JP-A-63-234245 can be cited as adsorbing groups of this type.

Specific examples of compounds represented by formula (V) are shown below, but the present invention is not limited to the compounds indicated below.

V-1

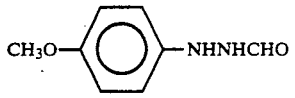

V-2

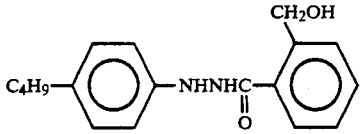

V-3

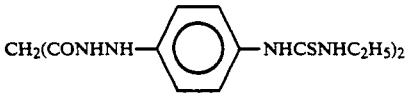

V-4

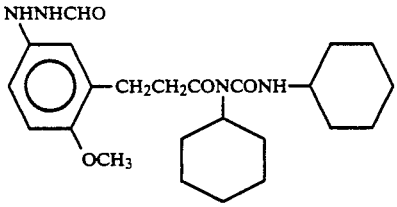

V-5

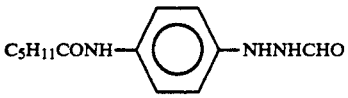

V-6

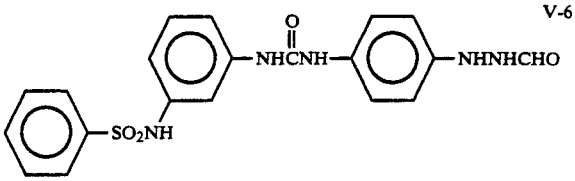

V-7

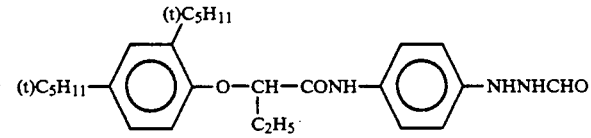

-continued
V-8
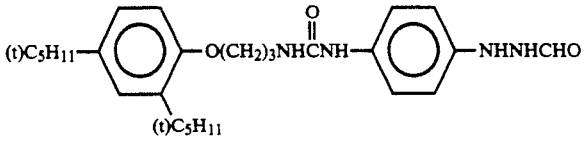
V-9
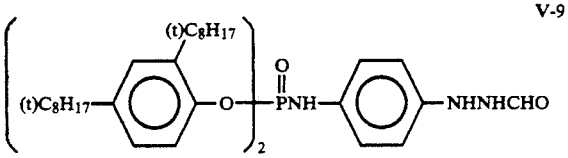
V-10
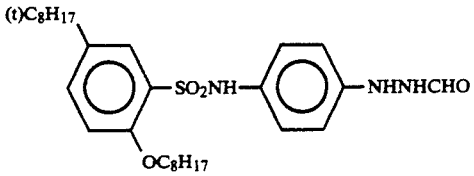
V-11
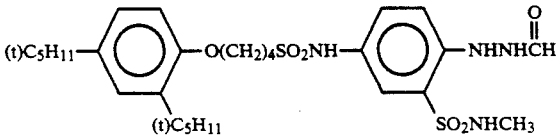
V-12
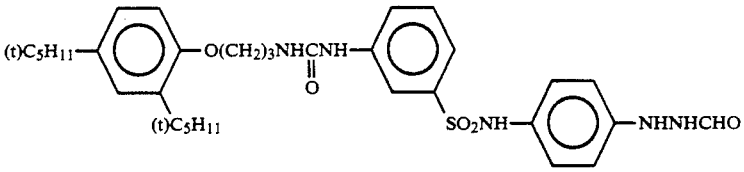
V-13
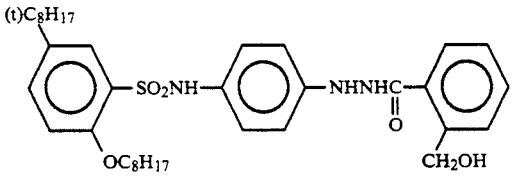
V-14
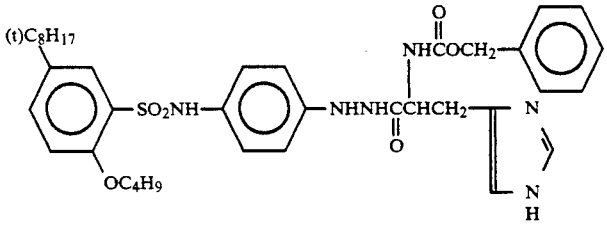
V-15
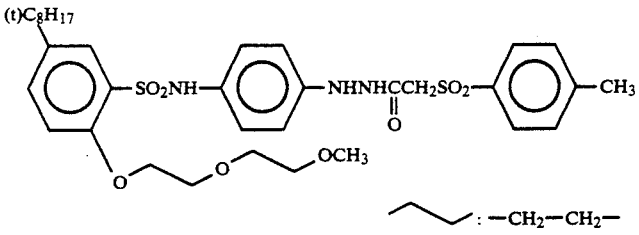
V-16
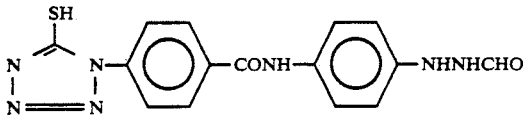
V-17
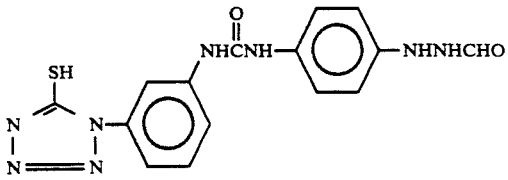

-continued
V-18
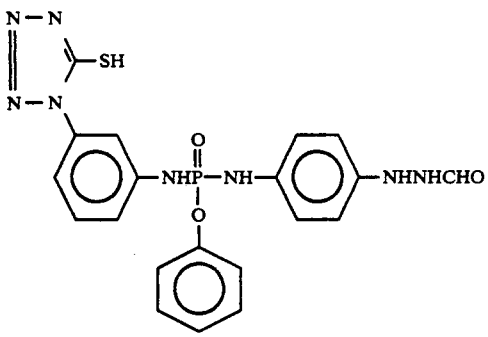
V-19
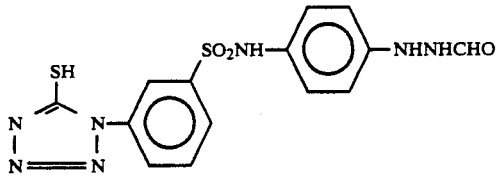
V-20
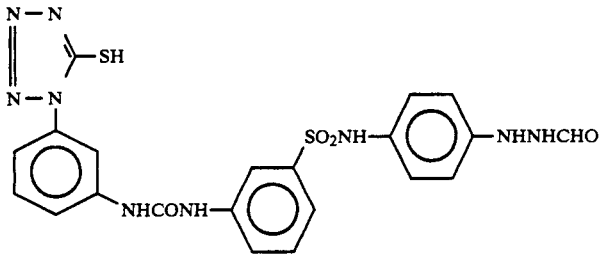
V-21
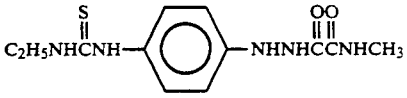
V-22
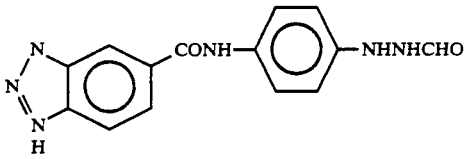
V-23
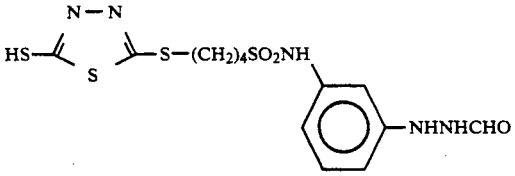
V-24
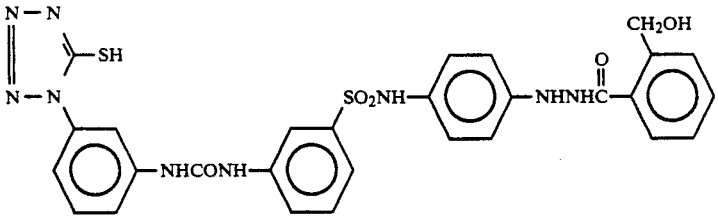
V-25
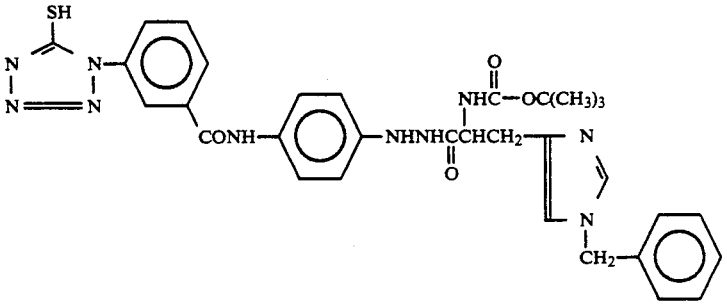

-continued

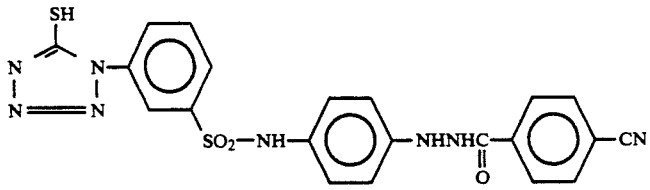

V-26

In addition to the compounds described above, the hydrazine derivatives disclosed in *Research Disclosure,* No. 23516 (November, 1983, page 346) and the patents cited therein, and in U.S. Pat. Nos. 4,080,027, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310 or U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-139538, JP-A-2-77057, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP-A-2-304550 can be used as hydrazine derivatives in the present invention.

The amount of hydrazine derivative employed in the present invention is preferably from $1\times10^{-6}$ mol to $5\times10^{-2}$ mol, and most desirably from $1\times10^{-5}$ mol to $2\times10^{-2}$ mol, per mol of silver halide.

The photosensitive silver halide emulsions in the present invention may be spectrally sensitized to comparatively long wavelength blue light, green light, red light or infrared light using sensitizing dyes. Cyanine dyes, merocyanine dyes, complex cyanine dyes, complex merocyanine dyes, holopolar cyanine dyes, styryl dyes, hemicyanine dyes, oxonol dyes and hemioxonol dyes, for example, can be used as sensitizing dyes.

Useful sensitizing dyes which can be employed in the present invention are disclosed in *Research Disclosure,* No. 17643, section IV-A (December, 1978, page 23) and in *Research Disclosure,* No. 1831 Section X (August, 1979, page 747) and in the literature cited therein.

Sensitizing dyes which have spectral sensitivities corresponding to the spectral characteristics of various scanner light sources can be selected appropriately.

For example: A) the simple merocyanine dyes disclosed in JP-A-60-162247, JP-A-2-48653, U.S. Pat. No. 2,161,331 and West German Patent 936,071 can be selected for an argon laser light source, B) the trinuclear cyanine dyes disclosed in JP-A-50-62425, JP-A-54-18726 and JP-A-59-102229 can be selected for a helium neon laser light source, C) the thiacarbocyanines disclosed in JP-B-48-42172, JP-B-51-9609, JP-B-55-39818 and JP-A-62-284343 can be selected for an LED light source, and D) the tricarbocyanines disclosed in JP-A-59-191032, JP-A-60-80841 and the 4-quinoline nucleus containing dicarbocyanines disclosed in JP-A-59-192242 can be selected for a semiconductor laser light source.

Typical examples of these sensitizing dyes are indicated below.

Compounds of Type A

A-1

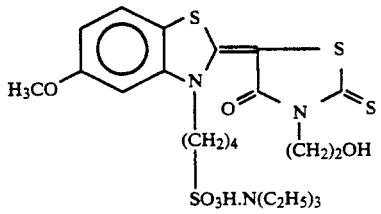

A-2

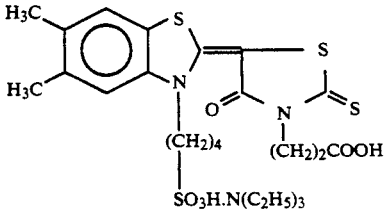

A-3

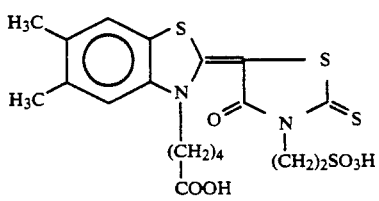

A-4

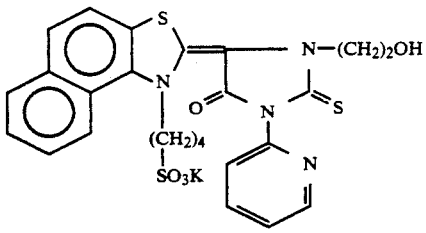

A-5

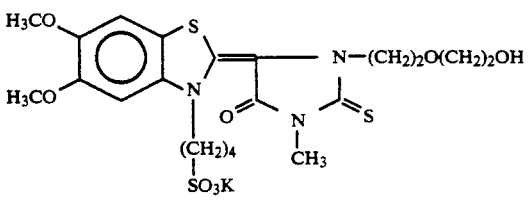

Compounds of Type B

B-1

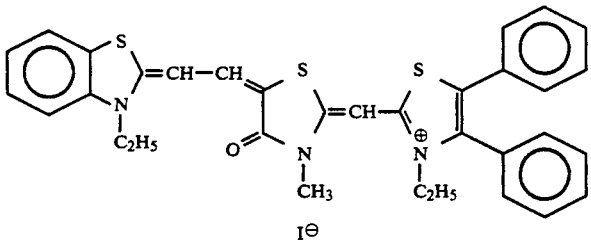

B-2

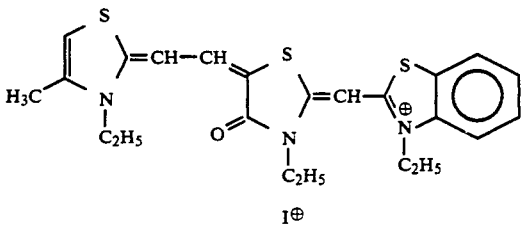

B-3

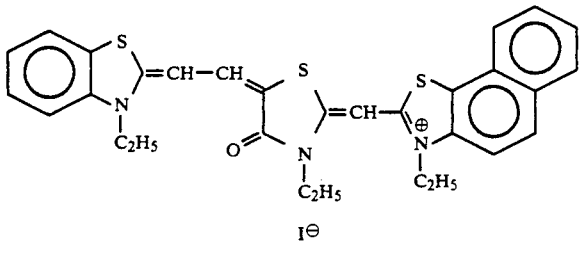

B-4

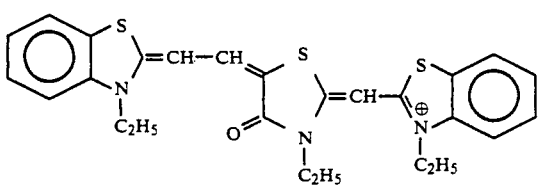

Compounds of Type (C)

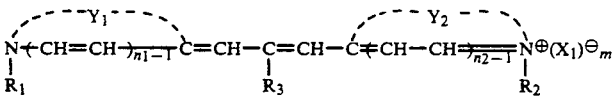

(VI)

In the formula (VI), $Y_1$ and $Y_2$ each represents a group of nonmetal atoms required to form a heterocyclic ring such as a benzothiazole ring, a benzoselenazole ring, a naphthothiazole ring, a naphthoselenazole ring or a quinoline ring, and these heterocyclic rings may be substituted with lower alkyl groups (having 1 to 6 carbon atoms), alkoxy groups, hydroxy groups, aryl groups, alkoxycarbonyl groups and halogen atoms.

$R_1$ and $R_2$ each represents a lower alkyl group having 1 to 6 carbon atoms, or an alkyl group having 1 to 6 carbon atoms which has a sulfo group or a carboxy group as a substituent.

$R_3$ represents a lower alkyl group, and $X_1$ represents an anion.

Moreover, $n_1$ and $n_2$ each represents 1 or 2.

Moreover, m represents 1 or 0, and m=0 when an intramolecular salt is formed.

C-1

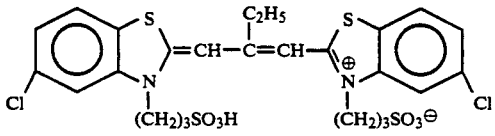

C-2

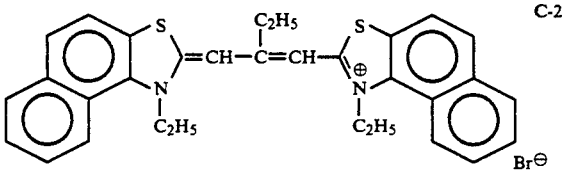

-continued
C-3
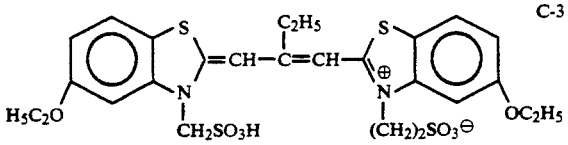
C-4
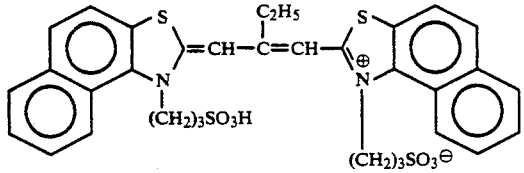
C-5
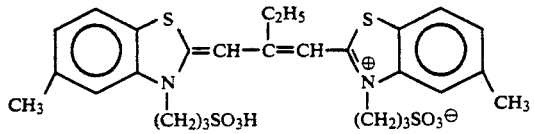
-continued
C-6
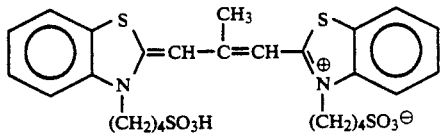
C-7
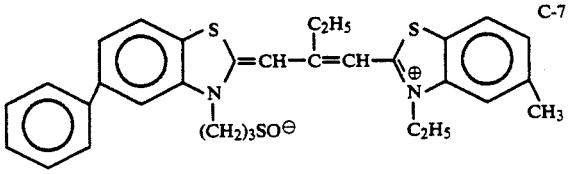
C-8
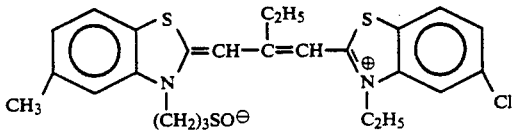
Compounds of Type D
D-1
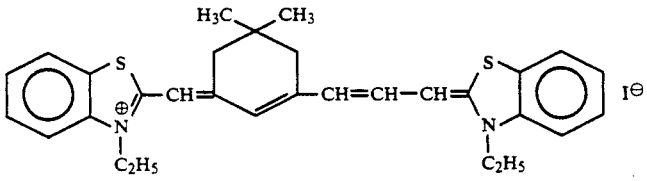
D-2
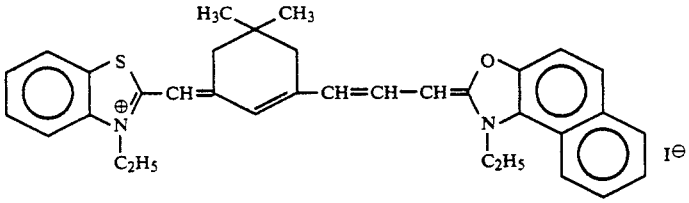
D-3
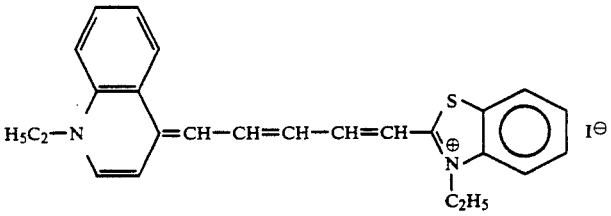
D-4
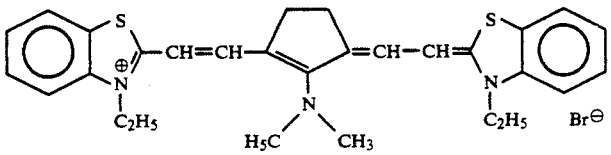
D-5
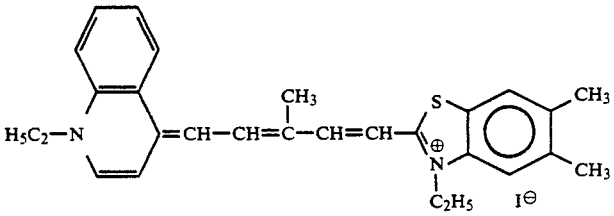

-continued

Compounds of Type D

D-6

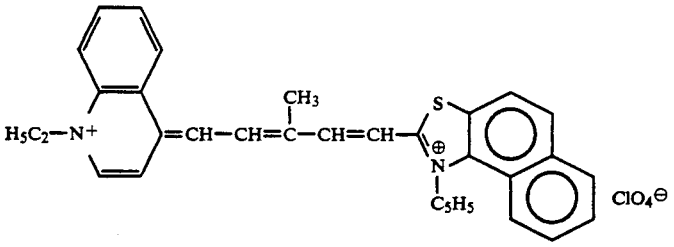

These sensitizing dyes may be used individually, or combinations of these dyes may be used. Combinations of sensitizing dyes are often used to achieve supersensitization. Substances which exhibit supersensitization, which are dyes themselves which have no spectral sensitizing action or substances which have essentially no absorption in the visible range, may also be present in the emulsion together with the sensitizing dyes.

Useful sensitizing dyes, combinations of dyes which exhibit supersensitization and substances which exhibit supersensitization are disclosed in *Research Disclosure,* Volume 176, 17643 (published December, 1978), page 23, Section IV-J. The amount of sensitizing dye included in the present invention is preferably selected optimally in accordance with the grain size, halogen composition and the method and extent of chemical sensitization of the silver halide emulsion, the relationship between the layer in which the compounds are included and the silver halide emulsion layer, and the type of anti-fogging compounds which are used. Test methods for making such a selection are well known to those in the art. Generally, the amount used is preferably within the range of from $1\times10^{-7}$ mol to $1\times10^{-2}$ mol, and most desirably within the range of from $1\times10^{-6}$ mol to $5\times10^{-3}$ mol, per mol of silver halide.

The silver halide which is used in the present invention may be, for example, silver chloride, silver bromide, silver iodide, silver chlorobromide, silver chloroiodide, silver iodobromide or silver chloroiodobromide. The use of silver chloroiodobromides, silver chlorobromides and silver iodobromides of the above silver halides is preferred in the present invention. The use of silver chlorobromides or silver chloroiodobromides having a silver iodide content of from 0 to 1 mol % is especially desirable.

The use of fine grains (for example, having average grain size of not more than 0.7 μm) is preferred in the present invention and the average grain size of the silver halide which is used in the present invention is most desirably 0.5 μm or less. No actual limitation on grain size distribution exists but monodispersions are preferred. Here, a monodispersion is one comprising grains such that at least 95% of the grains in terms of the number of grains or by weight are of a size within ±40% of the average grain size.

The silver halide grains in a photographic emulsion may have a regular crystalline form such as a cubic or octahedral form, an irregular crystalline form such as a spherical or plate-like form or a form which is a composite of these crystalline forms.

The silver halide grains may have a structure in which the interior and surface layer are a uniform phase or they may comprise a single phase. Mixtures of two or more types of silver halide emulsions which have different forms can also be used.

Furthermore, the silver halide emulsion layer may be a single layer or it may comprise multiple layers (of two or three layers, for example), and in the case of multiple layers the silver halide emulsions which are used may be the same or different.

Cadmium salts, lead salts, thallium salts, rhodium salts or complex salts thereof or iridium salts or complex salts thereof, for example, may be present during the processes of silver halide grain formation or physical ripening of a silver halide emulsion used in the present invention.

The use of water soluble rhodium salts, typically rhodium chloride, rhodium trichloride and rhodium ammonium chloride, for example, is preferred in the present invention. Moreover, complex salts of the water soluble rhodium salts can also be used. The time of the addition of these rhodium salts is before the completion of the first ripening during the manufacture of the emulsion, and addition during grain formation is particularly desirable. The amount added is preferably in the range of at least $1\times10^{-8}$ mol but not more than $1\times10^{-6}$ mol per mol of silver.

Silver halides prepared in the presence of from $1\times10^{-8}$ to $1\times10^{-5}$ mol per mol of silver of an iridium salt or complex salt are especially suitable for use in the present invention.

The addition of the iridium salt in the amount indicated above before the end of physical ripening and especially during the formation of the grains in the preparation of the silver halide emulsion is desirable.

The iridium salts used are water soluble iridium salts or iridium complex salts, and examples include iridium trichloride, iridium tetrachloride, potassium salt of hexachloroiridium(III) acid, potassium salt of hexachloroiridium(IV) acid, and ammonium salt of hexachloroiridium(III) acid.

Gelatin is useful as the binding agent or protective colloid for a photographic emulsion, but other hydrophilic colloids may also be used. For example, gelatin derivatives; graft copolymers of gelatin and other polymers; proteins such as albumin and casein; cellulose derivatives such as hydroxyethyl cellulose, carboxymethyl cellulose and cellulose sulfate esters; sodium alginate; sugar derivatives such as starch derivatives; and various synthetic water soluble polymeric materials such as homopolymer or copolymers of poly(vinyl alcohol), partially acetalated poly(vinyl alcohol, poly(N-vinylpyrrolidone), poly(acrylic acid), poly(methacrylic acid), polyacrylamide, polyvinylimidazole and polyvinylpyrazole can be used.

The silver halide emulsions used in the present invention may or may not be chemically sensitized. Sulfur sensitization, reduction sensitization and noble metal sensitization methods are known for chemical sensitization of silver halide emulsions, and these methods may be used independently or in combination.

Gold sensitization is typical of noble metal sensitization methods and gold compounds, and principally gold complex salts, are used in this case. Noble metals other than gold, for example, complex salts of platinum, palladium and rhodium, may also be present.

Various sulfur compounds, such as thiosulfates, thioureas, thiazoles and rhodanines, for example, can be used as sulfur sensitizing agents as well as the sulfur compounds which are present in gelatin.

Stannous salts, amines, formamidinesulfinic acid and silane compounds, for example, can be used as reduction sensitizing agents.

The compounds disclosed in JP-A-60-140340 and JP-A-61-167939 can be present in the photosensitive material of the present invention to increase photographic speed and promote high contrast. These compounds may be used individually, or two or more compounds can be used in combination.

Various compounds can be present in a photosensitive material of the present invention to prevent fogging during the manufacture, storage or photographic processing of the photosensitive material, or to stabilize photographic performance. Thus, many compounds which are known as antifogging agents or stabilizers, including azoles, for example, benzothiazolium salts, nitroimidazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds, such as oxazolinethione, for example; azaindenes, for example, triazaindenes, tetraazaindenes (especially 4-hydroxy substituted (1,3,3a,7)tetraazaindenes) and pentaazaindenes; benzenethiosulfonic acid; benzenesulfinic acid and benzenesulfonic acid amide, for example, can be employed for these purposes. The use of benzotriazoles (for example, 5-methylbenzotriazole) and nitroindazoles (for example, 5-nitroindazole) is preferred. These compounds may be included in a processing bath, if desired.

Inorganic or organic gelatin hardening agents can be present in the photographic emulsions and the light-insensitive hydrophilic colloids in the present invention. For example, active vinyl compounds (for example, 1,3,5-triacryloyl-hexahydro-s-triazine, bis(vinylsulfonyl)methyl ether, N,N-methylenebis[β-(vinylsulfonyl)propionamide]), active halogen compounds (for example, 2,4-dichloro-6-hydroxy-s-triazine), mucohalogen acids (for example, mucochloric acid), N-carbamoylpyridinium salts (for example, (1-morpholylcarbonyl-3-pyridinio)methanesulfonate), and haloamidinium salts (for example, 1-(1-chloro-1-pyridinomethylene)pyrrolidinium, 2-naphthalenesulfonate) may be used either individually or in combination. Of these compounds, the active vinyl compounds disclosed in JP-A-53-41220, JP-A-53-57257, JP-A-59-162546 and JP-A-60-80846, and the active halogen compounds disclosed in U.S. Pat. No. 3,325,287 are preferred.

Various surfactants may be present for various purposes in the photographic emulsion layers or other hydrophilic layers of the photosensitive material of the present invention. They are used, for example, as coating aids or as antistatic agents, for emulsification and dispersion purposes, for the prevention of adhesion and for improving photographic performance (for example, accelerating development, increasing contrast or increasing photographic speed).

For example, nonionic surfactants such as saponin (steroid based), alkylene oxide derivatives (for example, polyethylene glycol, polyethylene glycol/polypropylene glycol condensate, polyethylene glycol alkyl ethers or polyethylene glycol aryl alkyl ethers, polyethylene glycol esters, polyethylene glycol sorbitan esters, polyalkylene glycol alkyl amines or amides and poly(ethylene oxide) adducts of silicones), glycidol derivatives (for example, alkenylsuccinic acid polyglyceride, alkylphenol polyglyceride), fatty acid esters of polyhydric alcohols and the alkyl esters of sugars; anionic surfactants which include acidic groups, such as carboxy groups, sulfo groups, phospho groups, sulfate groups and phosphate groups, for example, alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenyl ethers and polyoxyethylenealkylphosphates; amphoteric surfactants, such as amino acids, aminoalkylsulfonic acids, aminoalkyl sulfates or phosphates, alkylbetaines and amine oxides, and cationic surfactants such as alkylamine salts, aliphatic and aromatic quaternary ammonium salts, heterocyclic quaternary ammonium salts, for example, pyridinium salts and imidazolium salts, and phosphonium salts and sulfonium salts which contain aliphatic or heterocyclic rings can be used.

Matting agents such as silica, magnesium oxide and poly(methyl methacrylate), for example, can be present in the photographic emulsion layers or other hydrophilic colloid layers in a photosensitive material of the present invention to prevent adhesion.

Dispersions of water insoluble or sparingly soluble synthetic polymers can be included in the photosensitive material of the present invention to improve dimensional stability. For example, polymers in which alkyl (meth)acrylate, alkoxyalkyl (meth)acrylate, glycidyl (meth)acrylate, (meth)acrylamide, vinyl esters (for example, vinyl acetate), acrylonitrile, olefins or styrene, either alone or in combination, or combinations of these with acrylic acid, methacrylic acid, α,β-unsaturated dicarboxylic acids, hydroxyalkyl (meth)acrylate, sulfoalkyl (meth)acrylate or styrenesulfonic acid, for example, are used as the monomer components can be used.

Cellulose acetate, cellulose diacetate, nitrocellulose, polystyrene and poly(ethylene terephthalate), for example, can be used for the support of the photosensitive material of the present invention, but the use of poly(ethylene terephthalate) films is most desirable.

These supports may be subjected to a corona treatment using known methods, and subbing layer processing may be completed using known methods, if desired.

Furthermore, waterproofing layers which contain poly(vinylidene chloride) based polymers may be employed to increase dimensional stability which relates to the changes in dimensions which arise as a result of changes in temperature and humidity.

In addition to the compounds disclosed, for example, in JP-A-53-77616, JP-A-54-37732, JP-A-53-137133, JP-A-60-140340 and JP-A-60-14959, various compounds which contain N or S atoms are effective as development accelerators or accelerators for nucleation infectious development and are suitable for use in the present invention.

Compounds which have acid groups are preferably present in the silver halide emulsion layers and other layers of the photosensitive materials of the present invention. Organic acids such as salicylic acid, acetic acid and ascorbic acid, for example, and polymers or copolymers including acid monomers such as acrylic acid, maleic acid or phthalic acid as repeating units can be cited as compounds which have acid groups. Reference can be made to JP-A-61-223834, JP-A-61-228437, JP-A-62-25745, JP-A-62-55642 and JP-A-62-220947 in connection with these compounds. Ascorbic acid as a low molecular weight compound and water dispersible latexes of copolymers of acid monomers such as acrylic acid and crosslinking monomers which have two or more unsaturated groups, such as divinylbenzene, as polymeric compounds are especially desirable of these compounds.

There is no need to use conventional infectious developers or highly alkaline developers of pH close to 13 disclosed in U.S. Pat. No. 2,419,975, and stable developers can be used to obtain photographic characteristics of high photographic speed with super-high contrast using the silver halide photographic materials of the present invention.

More specifically, the silver halide photographic materials of the present invention can provide negative images of satisfactory super-high contrast using developers which contain at least 0.15 mol/liter of sulfite as a preservative and which have a pH of from 10.5 to 12.3, and especially a pH of from 11.0 to 12.0.

No special limitation is imposed on the developing agent used in the developer which is used in the present invention, but the inclusion of dihydroxy benzenes is desirable to readily obtain good halftone dot quality, and there are cases in which combinations of dihydroxybenzenes and 1-phenyl-3-pyrazolidones and combinations of dihydroxybenzenes and p-aminophenols are used.

Hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, for example, are preferred as the dihydroxybenzene developing agent which is used in the present invention.

1-Phenyl-3-pyrazolidone and developing agents derived therefrom which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

N-Methyl-p-aminophenol, p-aminophenol, N-(β-hydroxyethyl)-p-aminophenol, N-(4-hydroxyphenyl)glycine, 2-methyl-p-aminophenol and p-benzylaminophenol can be cited, for example, as p-aminophenol based developing agents which can be used in the present invention, and of these the use of N-methyl-p-aminophenol is preferred.

Use of the developing agent in an amount of from 0.05 mol/liter to 0.8 mol/liter is generally desirable. Furthermore, where combinations of dihydroxybenzenes and 1-phenyl-3-pyrazolidones or p-aminophenols are used, the dihydroxybenzenes are preferably used in amounts of from 0.05 mol/liter to 0.5 mol/liter and the 1-phenyl-3pyrazolidones or p-aminophenols are preferably used in amounts of 0.06 mol/liter or less.

The amino compounds disclosed in JP-A-2-208652 can also be used as developers in the present invention.

Sodium sulfite, potassium sulfite, lithium sulfite, ammonium sulfite, sodium bisulfite, potassium metabisulfite and formaldehyde/sodium bisulfite, for example, can be used as sulfite preservatives in the present invention. The sulfite is preferably present in an amount of at least 0.4 mol/liter, and more desirably in an amount of at least 0.5 mol/liter. Furthermore, an upper limit of up to 2.5 mol/liter is desirable.

Moreover, pH controlling agents and buffers, such as sodium hydroxide, potassium hydroxide, sodium carbonate, potassium carbonate, sodium triphosphate and potassium triphosphate, are included among alkali agents which can be used to set the pH. The pH of the developer is generally 10.5 to 12.3.

Compounds such as boric acid and borax, development inhibitors such as sodium bromide, potassium bromide and potassium iodide; organic solvents such as ethylene glycol, diethylene glycol, triethylene glycol, dimethylformamide, methyl cellosolve, hexylene glycol, ethanol and methanol; and antifoggants and agents for preventing the occurrence of black peppers such as 1-phenyl-5-mercaptotetrazole and indazole based compounds such as 5-nitroindazole, and benzotriazole based compounds such as 5-methylbenzotriazole, may be used as additives in addition to the components mentioned above, and color toning agents, surfactants, defoaming agents, hard water softening agents, film hardening agents and the amino compounds disclosed in JP-A-56-106244, for example, can be included, if desired.

The compounds disclosed in JP-A-56-24347 can be used in the developers of the present invention as agents for preventing silver contamination. The compounds disclosed in JP-A-61-267759 can be used as dissolution aids and can be added to the developer. Moreover, the compounds disclosed in JP-A-60-93433 or the compounds disclosed in JP-A-62-186259 can be used as pH buffers which are used in the developer.

Aqueous solutions which contain hardening agents (for example, water soluble aluminum compounds) and acetic acid and dibasic acids (for example, tartaric acid, citric acid and their salts), as required, in addition to a fixing agent can be used as a fixer, and the pH is preferably at least 3.8, and most desirably from 4.0 to 5.6.

Sodium thiosulfate and ammonium thiosulfate can be used as fixing agents and the use of ammonium thiosulfate is preferred from the standpoint of fixing rate. The amount of fixing agent used can be varied appropriately, but it is generally from about 0.1 to about 0.5 mol/liter.

Water soluble aluminum salts which are used principally as film hardening agents in fixers are compounds which are generally known as film hardening agents for acid film hardening fixers, and examples of the film hardening agents include aluminum chloride, aluminum sulfate and potassium alum.

Tartaric acid or derivatives thereof, or citric acid or derivatives thereof, can be used individually or as combinations of two or more thereof as the dibasic acid referred to above. These compounds are effective when used in amounts of at least 0.005 mol per liter of fixer, and they are especially effective when used in amounts of from 0.01 mol/liter to 0.03 mol/liter.

Actual examples include tartaric acid, potassium tartrate, sodium tartrate, potassium sodium tartrate, ammonium tartrate and ammonium potassium tartrate.

Examples of citric acid and derivatives thereof which are effective in the present invention include citric acid, sodium citrate and potassium citrate.

Preservatives (for example, sulfite, bisulfite), pH buffers (for example, acetic acid, boric acid), pH controlling agents (for example, ammonia, sulfuric acid), agents for improving image storage (for example, potassium iodide) and chelating agents can be present if desired in a fixer. Here, the pH buffers are used in amounts of from 10 to 100 g/liter and preferably in amounts of from 18 to 25 g/liter, since the pH of the developer is high.

The photosensitive material of the present invention exhibits excellent rapid processing performance with a total processing time in an automatic processor of from 15 seconds to 60 seconds.

The times and temperatures of the development and fixing in the rapid development processing in the present invention are generally not more than 25 seconds at a temperature of from about 25° C. to 50° C., and preferably from 4 to 15 seconds at a temperature of from 30° C. to 40° C.

A water washing or stabilization process is preferably carried out after the development and fixation of the photosensitive material in the present invention. Here, the water washing process can be carried out using a two or three stage countercurrent washing system in order to economize on water usage. Furthermore, the establishment of squeegee roller washing tanks is desirable when washing with a small amount of water in order to reduce the amount of washing water. Moreover, part or all of the overflow from the water washing bath or stabilizing bath can be used in the fixer as disclosed in JP-A-60-235133. The amount of liquid effluent is reduced when this is done and this is desirable.

Furthermore, fungicides (for example, the compounds disclosed in Horiguchi, *The Chemistry of Biocides and Fungicides,* and in JP-A-62-115154), washing accelerators (sulfites, for example) and chelating agents may be present in the water washing water.

The time and temperature in the washing or stabilizing bath using the method described above is from 5 seconds to 30 seconds at a temperature of from 0° C. to 50° C., and preferably from 4 seconds to 20 seconds at a temperature of from 15° C. to 40° C.

In the present invention the developed, fixed and washed photosensitive material is dried through a squeegee roller. The drying is carried out for from 4 seconds to 30 seconds at a temperature of from 40° C. to 80° C.

The total processing time in the present invention is the total time elapsed from the entry of the leading edge of the film into the inlet port of the automatic processor, through the development tank, the carry-over part (i.e., traveling part), the fixing tank, the carry-over part, the water washing tank, the carry-over part and the drying part until the leading edge of the film emerges from the drier.

The amount of gelatin which is used for the binder in the emulsion layers and protective layers can be reduced in the silver halide photographic material of the present invention without the disadvantage of pressure fogging and so development processing can be carried out without loss of developing speed, fixing speed or drying speed even with rapid processing with a total processing time of from 15 to 60 seconds.

The present invention is described more specifically below by means of illustrative examples, but the present invention is not to be construed as being limited by these examples. Unless otherwise indicated herein, all parts, percents, ratios and the like are by weight.

EXAMPLE 1

| Preparation of Emulsion | |
|---|---|
| First Liquid | |
| Water | 1,000 ml |
| Gelatin | 20 g |
| Sodium Chloride | 20 g |
| 1,3-Dimethylimidazolidine-2-thione | 20 mg |
| Sodium Benzenethiosulfonate | 6 mg |
| Second Liquid | |
| Water | 400 ml |
| Silver Nitrate | 100 g |
| Third Liquid | |
| Water | 400 ml |
| Sodium Chloride | 30.5 g |
| Potassium Bromide | 14.0 g |
| Hexachloroiridium(III) Acid Potassium Salt (0.001% aqueous solution) | 15 ml |
| Hexabromorhodium(III) Acid Ammonium Salt (0.001% aqueous solution) | 1.5 ml |

The second and third liquids were added simultaneously over a period of 10 minutes, with stirring, to the first liquid which was maintained at 38° C., pH 4.5 and nuclei grains having a diameter of 0.16 μm were formed. Then, the fourth and fifth liquids shown below were added over a period of 10 minutes. Moreover, 0.15 g of potassium iodide was added and grain formation was completed.

| | |
|---|---|
| Fourth Liquid | |
| Water | 400 ml |
| Silver Nitrate | 100 g |
| Fifth Liquid | |
| Water | 400 ml |
| Sodium Chloride | 30.5 g |
| Potassium Bromide | 14.0 g |
| $K_4Fe(CN)_6$ | $3 \times 10^{-5}$ mol/mol-Ag |

The mixture was subsequently washed using the flocculation method and 30 g of gelatin was added.

The emulsion so obtained was divided into four equal parts, the pH was adjusted to 5.1, the pAg was adjusted to 7.5 and 2 mg of sodium thiosulfate and 3 mg of chloroauric acid were added and optimal chemical sensitization was carried out at 60° C. Moreover, 50 mg of 2-methyl-4-hydroxy-1,3,3a,7-tetraazaindene was added as a stabilizer and 100 mg/mol-Ag of C-1 and C-4 were added as spectral sensitizing dyes.

Phenoxyethanol was added at a concentration of 100 ppm as a fungicide, and finally a cubic silver iodochlorobromide emulsions having average grain size of 0.20 μm which contained 80 mol % of silver chloride was obtained (variation coefficient: 9%).

Hydroquinone and 1-phenyl-5-mercaptotetrazole were added to the emulsion as antifoggants in amounts of 2.5 g and 50 mg respectively per mol of silver, poly(ethyl acrylate) latex was added in an amount of 25% with respect to the gelatin binder as a plasticizer, and 2-bis(vinylsulfonylacetamido)ethane was added as a film hardening agent and, moreover, colloidal silica was added as shown in Table 1 below. The emulsions were then coated on polyester supports as to provide a coated silver weight of 3.0 g/m$^2$ and a coated gelatin weight of 1.0 g/m$^2$.

| | per $m^2$ |
|---|---|
| Lower Protective Layer | |
| Gelatin | 0.25 g |
| Compound (1) | 250 mg |
| Sodium Benzenethiosulfonate | 4 mg |
| 1,5-Dihydroxy-2-benzaldoxime | 25 mg |
| Poly(ethyl acrylate) Latex | 125 mg |
| Upper Protective Layer | |
| Gelatin | 0.25 g |
| Silica Matting Agent | 50 mg |
| (average size: 2.5 μm) | |
| Silicone Oil | See Table 1 |
| Colloidal Silica | See Table 1 |
| (particle size: from 10 to 20 μm) | |
| Compound (2) | 5 mg |
| Sodium Dodecylbenzenesulfonate | 22 mg |

Compound (1)

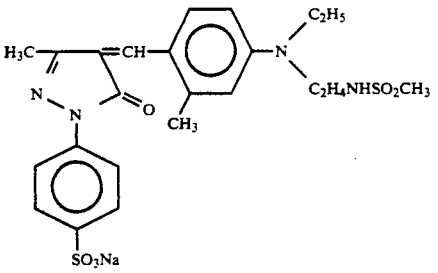

Compound (2)

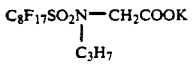

Moreover, the support used in this example had a backing layer and a backing protective layer of the compositions indicated below.

| | |
|---|---|
| Gelatin | 3.2 g/$m^2$ |
| Sodium Dodecylbenzenesulfonate | 80 mg/$m^2$ |
| Compound (3) | 70 mg/$m^2$ |
| Compound (4) | 85 mg/$m^2$ |
| Compound (5) | 90 mg/$m^2$ |
| 1,3-Divinylsulfone-2-propanol | 60 mg/$m^2$ |
| Backing Protective Layer | |
| Gelatin | 0.5 g/$m^2$ |
| Poly(methyl methacrylate) | 30 mg/$m^2$ |
| (particle size: 4.7 μm) | |
| Sodium Dodecylbenzensulfonate | 20 mg/$m^2$ |
| Compound (2) | 2 mg/$m^2$ |

-continued

| | |
|---|---|
| Silicone Oil | 100 mg/$m^2$ |

Compound (3)

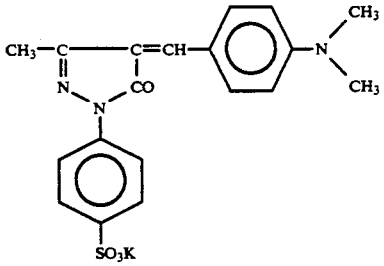

Compound (4)

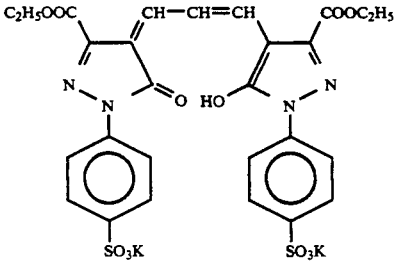

Compound (5)

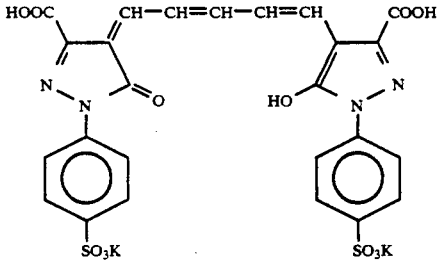

Samples 1 to 20 obtained in this way were evaluated as to 1) relative photographic speeds, 2) pressure fogging and 3) dynamic friction coefficient. The results obtained are shown in Table 2 below.

The methods used for these evaluations are described below.

1) Evaluation of Photographic Performance

The samples obtained were exposed with a xenon flash light of $1\times10^{-6}$ sec through an interference filter which had a peak at 670 nm and a continuous wedge, processed at the times and temperatures indicated below using an automatic processor FG-710NH made by the Fuji Photo Film Co., Ltd. and subjected to sensitometry.

Furthermore, LD835 and FL308 made by the Fuji Photo Film Co., Ltd. were used as the developer and fixer, respectively.

| | Temperature (°C.) | Time (seconds) |
|---|---|---|
| Development | 38 | 14 |
| Fixing | 37 | 9.7 |
| Water Washing | 26 | 9 |
| Squeegee | — | 2.4 |
| Drying | 55 | 8.3 |
| Total | — | 43.4 |

The reciprocal of the exposure required to provide a density of 3.0 was taken as the photographic speed and this is shown as a relative speed.

2) Pressure Fogging

The surface of the samples was rubbed with a sapphire needle of a diameter of 1 mm under a load of from 0 to 200 g under conditions of 25° C., 60% RH and then the samples were developed and processed under the same conditions as in 1) above and the load under which pressure fogging occurred was measured.

3) Dynamic Friction Coefficient (μk)

The dynamic friction coefficient was measured under conditions of 25° C., 60% RH using a sapphire needle of a diameter of 1 mm with a load of 100 g after the sample was left to stand for 1 hour as the speed in 60 cm/min.

TABLE 1

| | Emulsion Layer | | Upper Protective Layer | | | |
|---|---|---|---|---|---|---|
| Sample No. | Colloidal Silica Particle Size (mμ) | Coated Weight (g/m²) | Lubricant | Coated Weight (g/m²) | Colloidal Silica Particle Size (mμ) | Coated Weight (g/m²) |
| 1 (Comparison) | — | — | — | — | — | — |
| 2 (Invention) | 10–20 | 0.1 | II-f | 0.030 | — | — |
| 3 (Invention) | 10–20 | 0.2 | II-f | 0.030 | — | — |
| 4 (Invention) | 10–20 | 0.4 | II-f | 0.030 | — | — |
| 5 (Invention) | 10–20 | 0.6 | II-f | 0.030 | — | — |
| 6 (Invention) | 45–55 | 0.1 | II-f | 0.030 | — | — |
| 7 (Invention) | 45–55 | 0.4 | II-f | 0.030 | — | — |
| 8 (Invention) | 210–220 | 0.1 | II-f | 0.030 | — | — |
| 9 (Invention) | 210–220 | 0.4 | II-f | 0.030 | — | — |
| 10 (Invention) | 500–520 | 0.1 | II-f | 0.030 | — | — |
| 11 (Invention) | 500–520 | 0.4 | II-f | 0.030 | — | — |
| 12 (Invention) | 10–20 | 0.1 | II-f | 0.030 | 10–20 | 0.03 |
| 13 (Invention) | 10–20 | 0.4 | — | — | 10–20 | 0.06 |
| 14 (Comparison) | 10–20 | 0.4 | — | — | — | — |
| 15 (Comparison) | 10–20 | 0.6 | — | — | — | — |
| 16 (Comparison) | — | — | II-f | 0.010 | — | — |
| 17 (Comparison) | — | — | II-f | 0.030 | — | — |
| 18 (Comparison) | — | — | II-f | 0.060 | — | — |
| 19 (Comparison) | — | — | — | — | 10–20 | 0.03 |
| 20 (Comparison) | — | — | — | — | 10–20 | 0.06 |

TABLE 2

| Sample No. | Relative Speed | Pressure Fogging (g) | Dynamic Friction Coefficient (μk) |
|---|---|---|---|
| 1 (Comparison) | 100 | 15 | 0.41 |
| 2 (Invention) | 100 | 150 | 0.33 |
| 3 (Invention) | 100 | 170 | 0.33 |
| 4 (Invention) | 100 | 190 | 0.32 |
| 5 (Invention) | 100 | 200 | 0.31 |
| 6 (Invention) | 100 | 170 | 0.33 |
| 7 (Invention) | 100 | 190 | 0.32 |
| 8 (Invention) | 100 | 130 | 0.34 |
| 9 (Invention) | 100 | 150 | 0.33 |
| 10 (Invention) | 100 | 130 | 0.34 |
| 11 (Invention) | 100 | 150 | 0.33 |
| 12 (Invention) | 100 | 190 | 0.31 |
| 13 (Invention) | 100 | 190 | 0.31 |
| 14 (Comparison) | 100 | 30 | 0.41 |
| 15 (Comparison) | 100 | 40 | 0.40 |
| 16 (Comparison) | 100 | 25 | 0.37 |
| 17 (Comparison) | 100 | 40 | 0.34 |
| 18 (Comparison) | 100 | 50 | 0.27 |
| 19 (Comparison) | 100 | 40 | 0.37 |
| 20 (Comparison) | 100 | 50 | 0.35 |

It is clearly seen from the results in Table 2 that Samples 2 to 13 of the present invention were markedly improved in pressure fogging by the presence of colloidal silica in the emulsion layer and/or the inclusion of a lubricant in the outermost layer when compared with Samples 14 to 15 in which colloidal silica was present in the emulsion layer or Samples 16 to 20 in which a lubricant or colloidal silica was present in only the outermost layer.

EXAMPLE 2

An aqueous silver nitrate solution and an aqueous solution of a solution which contained $3\times10^{-7}$ mol of $K_3IrCl_6$ and $3\times10^{-7}$ mol of $(NH_4)_3RhCl_6$ per mol of silver and sodium bromide corresponding to 30 mol % per mol of silver were added simultaneously over a period of 30 minutes to an aqueous gelatin solution which was maintained at 48° C. and a monodisperse silver chlorobromide emulsion of an average grain size of 0.28 μm was prepared by maintaining the potential during this time at 70 mV. A 1% aqueous solution of potassium iodide was added to the obtained emulsion in an amount of 0.2 mol % per mol of silver and, after conversion, the emulsion was desalted using the flocculation method. Sodium thiosulfate and chloroauric acid were added to the emulsion and chemical sensitization was carried out while maintaining a temperature of 60° C., after which a 1% aqueous solution of 4-hydroxy-6-methyl-1,3,3a,7-tetraazaindene was added in an amount of 30 ml per mol of silver.

This emulsion was sensitized to the infrared region by adding 60 ml of a 0.05% solution of the infrared sensitizing dye represented by D-2 to 1 kg of the emulsion. A 0.5% methanol solution (70 ml) of 4,4'-bis-(4,6-dinaphthoxypyrimidin-2-ylamino)stilbene disulfonic acid, disodium salt and 90 ml of a 0.5% methanol solution of 2,5-dimethyl-3-allylbenzothiazole iodide were added to the emulsion for supersensitization and stabilization. Moreover, colloidal silica as shown in Table 3 below, 100 mg/m² of hydroquinone, 25% with respect to the gelatin binder of poly(ethyl acrylate) latex as a plasticizer and 160 mg/m² of 2-bis(vinylsulfonylacetamido)ethane as a film hardening agent were added and the obtained emulsions were coated on a polyester support in a coated weight of silver of 3.4 g/m². The coated weight of gelatin was 2.0 g/m².

The lower and upper protective layers of the formulations shown below were coated over the emulsion layer.

| Lower Protective Layer | |
|---|---|
| Gelatin | 0.25 g/m$^2$ |
| Compound (6) | 20 mg/m$^2$ |
| Compound (7) | 10 mg/m$^2$ |
| Sodium Dodecylbenzenesulfonate | 20 mg/m$^2$ |
| Poly(ethyl acrylate) Latex (0.05 μm) | 150 mg/m$^2$ |
| Upper Protective Layer | |
| Gelatin | 0.25 g/m$^2$ |
| Fine Poly(methyl methacrylate) Particles (average particle size: 3.4 μm) | 60 mg/m$^2$ |
| Colloidal Silica (particle size: 10–20 mμ) | 30 mg/m$^2$ |
| Compound II-f | Table 3 |
| Sodium Dodecylbenzenesulfonate | 40 mg/m$^2$ |
| Compound (2) of Example 1 | 10 mg/m$^2$ |

Compound (6)

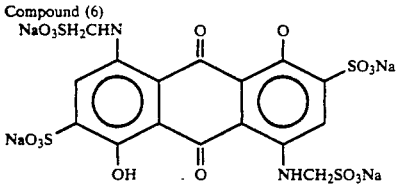

Compound (7)

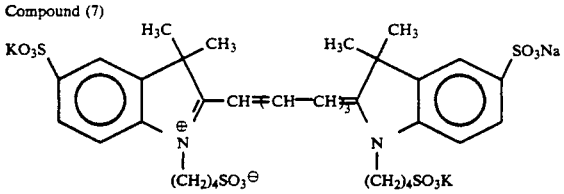

Next, a backing layer and a protective layer of the formulations shown below coated on the reverse side.

| Backing Layer | |
|---|---|
| Gelatin | 2.0 g/m$^2$ |
| Compound (4) of Example 1 | 34 mg/m$^2$ |
| Compound (5) of Example 1 | 90 mg/m$^2$ |
| Compound (7) | 70 mg/m$^2$ |
| Poly(ethyl acrylate) Latex (average size: 0.05 μm) | 400 mg/m$^2$ |
| Sodium Dodecylbenzenesulfonate | 35 mg/m$^2$ |
| 1,3-Divinylsulfonyl-2-propanol | 50 mg/m$^2$ |
| Poly(sodium styrenesulfonate) | 20 mg/m$^2$ |
| Protective Layer | |
| Gelatin | 0.5 g/m$^2$ |
| Fine Poly(methyl methacrylate) Particles (average particle size: 3.4 μm) | 40 mg/m$^2$ |
| Sodium Dodecylbenzenesulfonate | 10 mg/m$^2$ |
| Compound (2) | 2 mg/m$^2$ |

-continued

| | |
|---|---|
| Sodium Acetate | 25 mg/m$^2$ |

Samples 21 to 29 obtained in this way were evaluated with respect to 1) relative photographic speed (using an interference filter which had a peak at 780 nm), 2) pressure fogging and 3) dynamic friction coefficient in the same way as described in Example 1.

The results obtained are shown in Table 3.

TABLE 3

| | Emulsion Layer | | Upper Protective Layer | | | | |
|---|---|---|---|---|---|---|---|
| Sample No. | Colloidal Silica Particle Size (mμ) | Coated Weight (g/m$^2$) | Lubricant | Coated Weight (g/m$^2$) | Relative Speed | Pressure Fogging (g) | Dynamic Friction Coefficient (μk) |
| 21 (Comparison) | — | — | — | — | 100 | 20 | 0.40 |
| 22 (Comparison) | 10–20 | 0.2 | — | — | 100 | 25 | 0.40 |
| 23 (Comparison) | 10–20 | 0.4 | — | — | 100 | 40 | 0.39 |
| 24 (Comparison) | 10–20 | 0.6 | — | — | 100 | 50 | 0.39 |
| 25 (Comparison) | 10–20 | 0.8 | — | — | 100 | 50 | 0.38 |
| 26 (Invention) | 10–20 | 0.2 | II-f | 0.040 | 100 | 170 | 0.29 |
| 27 (Invention) | 10–20 | 0.4 | II-f | 0.040 | 100 | 170 | 0.29 |
| 28 (Invention) | 10–20 | 0.6 | II-f | 0.040 | 100 | 200 | 0.29 |
| 29 (Invention) | 10–20 | 0.8 | II-f | 0.040 | 100 | 200 | 0.28 |

It is clearly seen from the results in Table 3 that Samples 26 to 29 of the present invention had markedly improved pressure fogging.

EXAMPLE 3

An aqueous silver nitrate solution and an aqueous potassium iodide, potassium bromide solution were added simultaneously over a period of 60 minutes in the presence of $4\times10^{-7}$ mol per mol of silver of potassium salt of hexachloroiridium(III) acid, and ammonia to an aqueous gelatin solution which was maintained at 50° C., and, by maintaining the pAg at 7.8 during this period, a cubic monodisperse emulsion having an average silver iodide content of 1 mol % and an average grain size of 0.28 μm was obtained. This emulsion was washed in the usual way and the soluble salts were removed, after which gelatin was added. Then 0.1 mol % per mol of silver of an aqueous potassium iodide solution was added and the grain surfaces were subjected to conversion and Emulsion A was obtained.

Illustrative Compounds C-1 and C-4 of formula (VI) ($4.0\times10^{-5}$ mol/mol-Ag of each) as sensitizing dyes, and $1.2\times10^{-3}$ mol/mol-Ag of Compound V-7 of formula (V) and $5.0\times10^{-5}$ mol/mol-Ag of Compound V-19 as hydrazine derivatives were added sequentially to Emulsion A, and 8 mg/m$^2$ of 4-hydroxy-6-methyl-1,3,3a,7-tetraazaindene as stabilizer, 600 mg/m$^2$ of poly(ethyl acrylate) latex (particle size: 0.05 μm), 20 mg/m$^2$ of 5-methylbenzotriazole, 10 mg/m$^2$ of 1,4-bis[3-(4-acetylaminopyridinio)propionyloxy]tetramethylenedibromide, the amounts shown in Table 4 below of colloidal silica and 145 mg/m$^2$ of 2-bis(vinylsulfonylacetamido)ethane were added sequentially and the emulsion was coated on a poly(ethylene terephthalate) film having a thickness of 100 μm to provide a coated silver weight of 3.5 g/m$^2$ and a gelatin coated weight of 2.0 g/m$^2$.

The lower and upper protective layers of the formulations shown below were then coated sequentially as a protective layer over the emulsion.

| | |
|---|---|
| Lower Protective Layer | |
| Gelatin | 0.3 g/m$^2$ |
| L-Ascorbic Acid | 30 mg/m$^2$ |
| Compound D-1 | 190 mg/m$^2$ |
| Ethyl Acrylate Latex (average particle size: 0.05 μm) | 150 mg/m$^2$ |
| Poly(sodium styrenesulfonate) | 3 mg/m$^2$ |
| Upper Protective Layer | |
| Gelatin | 0.3 g/m$^2$ |
| Fine Poly(methyl methacrylate) Particles (average particle size: 2.5 μm) | 60 mg/m$^2$ |
| Compound II-f | Table 4 |
| Colloidal Silica (particle size: 10–20 mμ) | 60 mg/m$^2$ |
| Sodium Dodecylbenzenesulfonate | 20 mg/m$^2$ |
| Compound (2) of Example 1 | 4 mg/m$^2$ |

Next, a backing layer and a protective layer of the formulations shown below were formed on the reverse side

| | |
|---|---|
| Backing Layer | |
| Gelatin | 3 g/m$^2$ |
| Compound (3) of Example 1 | 60 mg/m$^2$ |
| Compound (4) of Example 1 | 80 mg/m$^2$ |
| Compound (5) of Example 1 | 90 mg/m$^2$ |
| Dihexyl-α-sulfosuccinate Sodium Salt | 40 mg/m$^2$ |
| Sodium Dodecylbenzenesulfonate | 40 mg/m$^2$ |
| 1,3-Divinylsulfonyl-2-propanol | 120 mg/m$^2$ |
| Poly(ethyl acrylate) Latex (average size: 0.05 μm) | 300 mg/m$^2$ |
| Protective Layer | |
| Gelatin | 0.8 g/m$^2$ |
| Dihexyl-α-sulfosuccinate Sodium Salt | 15 mg/m$^2$ |
| Sodium Dodecylbenzenesulfonate | 15 mg/m$^2$ |
| Sodium Acetate | 40 mg/m$^2$ |
| Compound II-f | 100 mg/m$^2$ |
| Fine Poly(methyl methacrylate) Particles (average particle size: 3.4 μm) | 40 mg/m$^2$ |

Samples 30 to 38 obtained in this way were evaluated as to 1) relative photographic speed (using an interference filter which had a peak at 633 nm), 2) pressure fogging and 3) dynamic friction coefficient in the same way as described in Example 1. However, the development processing was carried out using GR-D1 (developer) and GR-F1 (fixer) made by Fuji Photo Film Co., Ltd. using an FG-660F automatic processor (Fuji Photo Film Co., Ltd.) under development conditions of 34° C., 30". The results obtained are shown in Table 4 below.

TABLE 4

| Sample No. | Emulsion Layer Colloidal Silica Particle Size (mμ) | Emulsion Layer Colloidal Silica Coated Weight (g/m$^2$) | Upper Protective Layer Lubricant | Upper Protective Layer Coated Weight (g/m$^2$) | Relative Speed | Pressure Fogging (g) | Dynamic Friction Coefficient (μk) |
|---|---|---|---|---|---|---|---|
| 30 (Comparison) | — | — | — | — | 100 | 13 | 0.40 |
| 31 (Comparison) | 10–20 | 0.2 | — | — | 100 | 24 | 0.39 |
| 32 (Comparison) | 10–20 | 0.4 | — | — | 100 | 29 | 0.39 |
| 33 (Comparison) | 10–20 | 0.6 | — | — | 100 | 35 | 0.39 |
| 34 (Comparison) | 10–20 | 0.8 | — | — | 100 | 40 | 0.39 |
| 35 (Invention) | 10–20 | 0.2 | II-f | 0.050 | 100 | 160 | 0.29 |
| 36 (Invention) | 10–20 | 0.4 | II-f | 0.050 | 100 | 170 | 0.29 |
| 37 (Invention) | 10–20 | 0.6 | II-f | 0.050 | 100 | 190 | 0.28 |
| 38 (Invention) | 10–20 | 0.8 | II-f | 0.050 | 100 | 190 | 0.28 |

As is clearly seen from the results in Table 4, Samples 35 to 38 of the present invention were markedly improved in pressure fogging.

EXAMPLE 4

Emulsion layers and lower and upper protective layers of the formulations shown below were coated simultaneously on one side of a biaxially stretched poly(ethylene terephthalate) film support having a subbing layer on both sides of a thickness of 100 μm.

Emulsion Layer

Solution I: Water 300 ml, Gelatin 7.2 g
Solution II: $AgNO_3$ 100 g, Water 400 ml
Solution III: KBr 69.7 g, KI 0.49 g, $K_3IrCl_6$ 0.123 mg, Water 500 ml Solution II and Solution III were added simultaneously at a constant rate to Solution I which was maintained at 50° C. Gelatin was added after removing the soluble salts from the emulsion. The average grain size of this monodisperse emulsion was 0.28 μm, and the gelatin content was 56 g per kg of emulsion.

The compounds shown below were added to the emulsion sol obtained.

| | |
|---|---|
| 5,5'-Dichloro-9-ethyl-3,3'-bis(3-sulfopropyl)oxacarbocyanine Sodium Salt | 11 mg/m$^2$ |
| 3-(3-Sulfopropyl)-3'-(4-sulfobutyl)-5'-phenyl-4,5-dibenzoxacyanine Sodium Salt | 6.9 mg/m$^2$ |
| 6-Methyl-4-hydroxy-1,3,3a,7-tetra-azaindene | 8 mg/m$^2$ |
| 5-methylbenzotriazole | 17 mg/m$^2$ |
| Compound (8) | 5 mg/m$^2$ |
| Compound V-7 | 1.2 × 10$^{-3}$ mol/mol-Ag |
| Compound V-19 | 5 × 10$^{-3}$ mol/mol-Ag |
| Polymer Latex | 195 mg/m$^2$ |

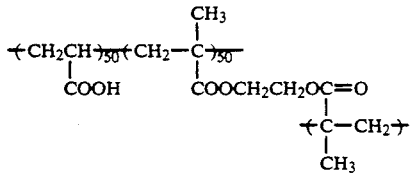

| | |
|---|---|
| Ethyl Acrylate Latex (average particle size: 0.05 μm) | 600 mg/m$^2$ |
| 1,2-bis(Vinylsulfonylacetamido)ethane | 140 mg/m$^2$ |
| N-Oleoyl-N-methyltaurine Sodium Salt | 40 mg/m$^2$ |
| Colloidal Silica | Table 5 |
| Poly(sodium styrenesulfonate) | 20 mg/m$^2$ |
| Lower Protective Layer | |
| Gelatin | 0.3 g/m$^2$ |
| Ascorbic Acid | 30 mg/m$^2$ |
| Hydroquinone | 190 mg/m$^2$ |
| Ethyl Acrylate Latex (average particle size: 0.05 μm) | 150 mg/m$^2$ |

-continued

| | |
|---|---|
| Poly(sodium styrenesulfonate) | 3 mg/m$^2$ |
| 2,4-Dichloro-6-hydroxy-1,3,5-triazine Sodium Salt | 12 mg/m$^2$ |

| Upper Protective Layer | |
|---|---|
| Gelatin | 0.3 g/m$^2$ |
| Fine poly(methyl methacrylate) Particles (average particle size: 2.5 μm) | 60 mg/m$^2$ |
| Compound II-f | Table 5 |
| Sodium Dodecylbenzenesulfonate | 20 mg/m$^2$ |
| N-Perfluorooctanesulfonyl-N-propylglycine Potassium Salt | 4 mg/m$^2$ |
| Colloidal Silica | 5 mg/m$^2$ |

Moreover, the backing layer and the protective layer of the formulations shown below were coated simultaneously onto the reverse side.

| Backing Layer | |
|---|---|
| Gelatin | 2.5 g/m$^2$ |
| Compound (3) of Example 1 | 40 mg/m$^2$ |
| Compound (4) of Example 1 | 30 mg/m$^2$ |
| Compound (5) of Example 1 | 40 mg/m$^2$ |
| Compound (9) | 120 mg/m$^2$ |
| Dihexyl-α-sulfosuccinate Sodium Salt | 40 mg/m$^2$ |
| Sodium Dodecylbenzenesulfonate | 40 mg/m$^2$ |
| 1,3-Divinylsulfonyl-2-propanol | 120 mg/m$^2$ |
| Protective Layer | |
| Gelatin | 0.8 g/m$^2$ |
| Fine Poly(methyl methacrylate) Particles (average particle size: 3.4 μm) | 30 mg/m$^2$ |
| Dihexyl-α-sulfosuccinate Sodium Salt | 15 mg/m$^2$ |
| Sodium Dodecylbenzenesulfonate | 15 mg/m$^2$ |
| Sodium Acetate | 40 mg/m$^2$ |

Compound (8)

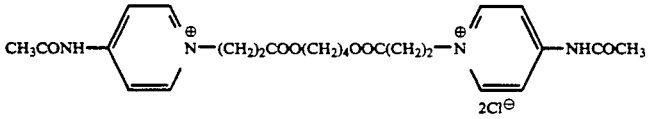

Compound (9)

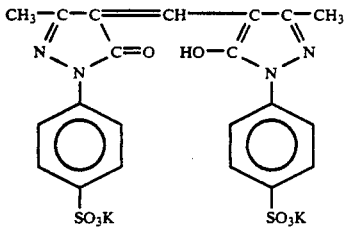

Samples 39 to 47 obtained in this way were evaluated in the same way as in Example 3. However, the exposure conditions for the relative speed involved the use of a tungsten light source of a color temperature of 3,200° K. and an exposure of 300 lux. The results obtained are shown in Table 5 below.

TABLE 5

| Sample No. | Emulsion Layer: Colloidal Silica Particle Size (mμ) | Emulsion Layer: Colloidal Silica Coated Weight (g/m$^2$) | Upper Protective Layer: Lubricant | Upper Protective Layer: Coated Weight (g/m$^2$) | Relative Speed | Pressure Fogging (g) | Dynamic Friction Coefficient (μk) |
|---|---|---|---|---|---|---|---|
| 39 (Comparison) | — | — | — | — | 100 | 25 | 0.42 |
| 40 (Comparison) | 10–20 | 0.4 | — | — | 100 | 40 | 0.41 |
| 41 (Comparison) | 10–20 | 0.6 | — | — | 100 | 45 | 0.41 |
| 42 (Comparison) | 10–20 | 0.8 | — | — | 100 | 50 | 0.40 |
| 43 (Invention) | 10–20 | 0.4 | II-f | 0.030 | 100 | 180 | 0.31 |
| 44 (Invention) | 10–20 | 0.6 | II-f | 0.030 | 100 | 190 | 0.31 |
| 45 (Invention) | 10–20 | 0.8 | II-f | 0.030 | 100 | 200 | 0.30 |
| 46 (Comparison) | — | — | II-f | 0.030 | 100 | 70 | 0.32 |
| 47 (Comparison) | — | — | II-f | 0.050 | 100 | 80 | 0.30 |

EXAMPLE 5

A silver chloroiodobromide emulsion (cubic, 2 mol % silver iodide, 33 mol % silver chloride) of average grain size 0.35 μm was prepared using the double jet method and, after desalting, the emulsion was subjected to gold and sulfur sensitization and 6-methyl-4-hydroxy-1,3,3a,7-tetraazaindene was added as a stabilizer and 150 mg per mol of silver halide in the emulsion of 1-(β-hydroxyethyl)-3-phenyl-5-[(3-α-sulfopropyl-α-benzoxazolidine)ethylidene]thiohydantoin was added as a sensitizing dye. Moreover, 500 mg per mol of silver halide of potassium bromide, 100 mg of sodium p-dodecylphenylsulfonate, 30 mg of 5-nitroindazole, 20 mg of 5-methylbenzotriazole, 1.5 g of styrene/maleic acid copolymer, 15 g of styrene/butyl acrylate copolymer latex (average particle size 0.25 μm), 800 mg of compound (10), 3.5 g of 2-bis(vinylsulfonylacetamido)ethane and the amount of colloidal silica as shown in Table 6 were added, and then the emulsions were coated onto a biaxially stretched poly(ethylene terephthalate) support having a subbing layer established on both sides in a coated silver weight of 4.0 g/m² and a coated gelatin weight of 2.0 g/m². Lower and upper protective layers of the same formulations as in Example 4 were coated simultaneously as a protective layer. However, Compound II-f was added to the upper protective layer in the amounts shown in Table 6.

Compound (10)

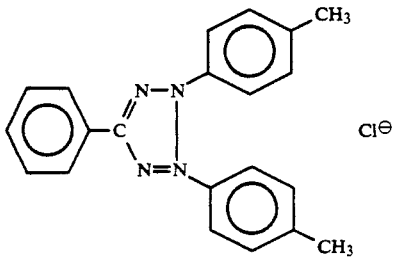

Samples 48 to 53 obtained in this way were evaluated in the same way as in Example 5. However, Konika developer CDM-651 and Konida fixer CFL-851 were used for development processing which was carried out with development conditions of 28° C., 30" using a GR-27 automatic processor made by Konika Co. The results obtained are shown in Table 6 below.

TABLE 6

| | Emulsion Layer | | Upper Protective Layer | | | | |
|---|---|---|---|---|---|---|---|
| | Colloidal Silica | | | | | | Dynamic |
| Sample No. | Particle Size (mμ) | Coated Weight (g/m²) | Lubricant | Coated Weight (g/m²) | Relative Speed | Pressure Fogging (g) | Friction Coefficient (μk) |
| 48 (Comparison) | — | — | — | — | 100 | 30 | 0.41 |
| 49 (Comparison) | 10–20 | 0.4 | — | — | 100 | 50 | 0.40 |
| 50 (Comparison) | 10–20 | 0.8 | — | — | 100 | 70 | 0.39 |
| 51 (Invention) | 10–20 | 0.4 | II-f | 0.040 | 100 | 190 | 0.30 |
| 52 (Invention) | 10–20 | 0.8 | II-f | 0.040 | 100 | 200 | 0.29 |
| 53 (Comparison) | — | — | II-f | 0.040 | 100 | 80 | 0.30 |

It is clearly seen from the results in Table 6 that Samples 51 and 52 of the present invention had markedly improved pressure fogging.

The present invention provides sensitive materials which had improved pressure fogging resistance which arises as a result of contact friction of the sensitive material with other substances and which are suitable for rapid processing, by including colloidal silica in the silver halide emulsion layer and setting the dynamic friction coefficient of the outermost surface layer on the side of the emulsion layer to 0.35 or less.

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon at least one silver halide emulsion layer containing colloidal silica having an average particle size of from 5 to 500 mμ and in a dry weight ratio based on gelatin in said silver halide emulsion layer of from 0.05 to 1.0, and at least one light insensitive protective layer disposed above said at least one silver halide emulsion layer containing said colloidal silica, and wherein an outermost layer of said at least one light insensitive protective layer has an exposed outer surface and contains a lubricant in an amount effective to provide a dynamic friction coefficient of said outer surface of 0.35 or less.

2. A silver halide photographic element as in claim 1, comprising at least one silver halide emulsion layer or other hydrophilic colloid layer containing at least one polyhydroxybenzene compound.

3. A silver halide photographic element as in claim 1, wherein the protective layer comprising two or more layers, the outermost of these layers contains a lubricant and colloidal silica and the protective layer which is disposed between the outermost protective layer and the emulsion layer contains a polymer latex having a glass transition point of 20° C. or less.

4. A silver halide photographic element as in claim 1, wherein the total processing time when processing in an automatic processor is from 15 seconds to 60 seconds.

5. A silver halide photographic element as in claim 1, wherein a ratio by weight of the lubricant based on the amount of binder in the outermost protective layer is from 0.01 to 1.0.

6. A silver halide photographic element as in claim 1, wherein said element further contains an anionic surfactant represented by formula (IV)

$$R-CON(R')(CH_2)_nSO_3M \quad \text{(IV)}$$

wherein R is a substituted or unsubstituted alkyl group having from 3 to 30 carbon atoms, an unsubstituted or substituted alkenyl group having from 3 to 30 carbon atoms or an unsubstituted or substituted aryl group having from 6 to 30 carbon atoms; R' is a hydrogen atom, a substituted or unsubstituted alkyl group having from 1 to 10 carbon atoms, an unsubstituted or substituted alkenyl group or an unsubstituted or substituted aryl group; n represents an integer of from 2 to 6; and M is a hydrogen atom, an inorganic cation or an organic cation.

7. A silver halide photographic element according to claim 1, wherein said element further contains a hydrazine derivative represented by formula (V):

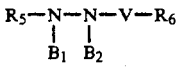

(V)

wherein $R_5$ is an aliphatic group or an aromatic group; and $R_6$ is a hydrogen atom, an alkyl group, an aryl group, an alkoxy group, an aryloxy group, an amino group or a hydrazine group; V is a

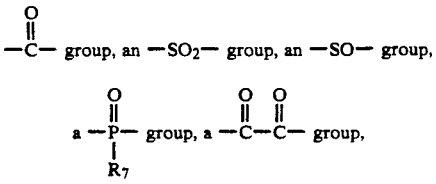

a thiocarbonyl group or an iminomethylene group; and $B_1$ and $B_2$ are hydrogen atoms, or one of $B_1$ and $B_2$ represents a hydrogen atom and the other is a substituted or unsubstituted alkylsulfonyl group, a substituted or unsubstituted arylsulfonyl group or a substituted or unsubstituted acyl group.

* * * * *